US009249952B2

(12) United States Patent
Markle et al.

(10) Patent No.: US 9,249,952 B2
(45) Date of Patent: Feb. 2, 2016

(54) MULTI-CONFIGURABLE, HIGH LUMINOUS OUTPUT LIGHT FIXTURE SYSTEMS, DEVICES AND METHODS

(75) Inventors: Joshua J. Markle, Raleigh, NC (US); Robert Higley, Cary, NC (US); Russell G. Villard, Apex, NC (US); Nicholas E. Desilva, Four Oaks, NC (US)

(73) Assignee: Cree, Inc., Durham, NC (US)

( * ) Notice: Subject to any disclaimer, the term of this patent is extended or adjusted under 35 U.S.C. 154(b) by 406 days.

(21) Appl. No.: 12/940,453

(22) Filed: Nov. 5, 2010

(65) Prior Publication Data

US 2012/0113640 A1 May 10, 2012

(51) Int. Cl.

| | |
|---|---|
| ***F21S 4/00*** | (2006.01) |
| ***F21V 14/02*** | (2006.01) |
| ***F21S 8/04*** | (2006.01) |
| ***F21S 8/06*** | (2006.01) |
| *F21K 99/00* | (2010.01) |
| *F21V 19/04* | (2006.01) |
| *F21V 23/04* | (2006.01) |
| *F21Y 101/02* | (2006.01) |
| *F21Y 111/00* | (2006.01) |
| *F21V 29/74* | (2015.01) |

(52) U.S. Cl.

CPC . *F21V 14/02* (2013.01); *F21S 8/04* (2013.01); *F21S 8/061* (2013.01); *F21K 9/58* (2013.01); *F21V 19/04* (2013.01); *F21V 23/04* (2013.01); *F21V 29/74* (2015.01); *F21Y 2101/02* (2013.01); *F21Y 2111/007* (2013.01)

(58) Field of Classification Search

CPC ..... F21K 9/58; F21V 14/02; F21V 19/04
USPC ..... 362/249.02, 418, 249.01, 249.11, 362/249.13, 800, 457
See application file for complete search history.

(56) References Cited

U.S. PATENT DOCUMENTS

| | | | | |
|---|---|---|---|---|
| 4,946,547 | A | 8/1990 | Palmour | |
| 5,200,022 | A | 4/1993 | Kong | |
| 5,210,051 | A | 5/1993 | Carter | |
| RE34,861 | E | 2/1995 | Davis et al. | |
| 5,393,993 | A | 2/1995 | Edmond | |
| 5,523,589 | A | 6/1996 | Edmond | |
| 6,908,214 | B2 * | 6/2005 | Luk | 362/249.02 |
| 7,784,971 | B2 * | 8/2010 | Dorogi | 362/249.02 |
| 2006/0186418 | A1 | 8/2006 | Edmond | |
| 2007/0285920 | A1 * | 12/2007 | Seabrook | 362/240 |
| 2008/0002413 | A1 * | 1/2008 | Wang et al. | 362/341 |
| 2008/0258130 | A1 | 10/2008 | Bergmann | |
| 2009/0141494 | A1 * | 6/2009 | Zhang et al. | 362/249.03 |
| 2010/0315810 | A1 * | 12/2010 | Tseng | 362/234 |
| 2011/0205738 | A1 * | 8/2011 | Peifer et al. | 362/249.02 |

OTHER PUBLICATIONS

"Pendant," SPI Lighting, p. 11 (2003).
Lumileds, "Thermal Design Using LUXEON Power Light Sources," Application Brief AB05, pp. 1-11 (2006).
"4-bar LED," C-Series High Bay, pp. 1-2 (2010).

* cited by examiner

*Primary Examiner* — Anh Mai
*Assistant Examiner* — Jessica M Apenteng
(74) *Attorney, Agent, or Firm* — Jenkins, Wilson, Taylor & Hunt, P.A.

(57) ABSTRACT

Multi-configurable, high luminous output light fixture systems, devices, and methods are disclosed. Light fixtures can be configured to produce variable light emission outputs and patterns and can include LED packages wherein at least one can be movable with respect to another of the LED packages. In addition, a power supply can selectively dim or turn off at least one of the LED packages. The light fixtures disclosed herein can be used in both high bay and low bay light fixtures.

32 Claims, 10 Drawing Sheets

MULTI-CONFIGURABLE, HIGH LUMINOUS OUTPUT LIGHT FIXTURE SYSTEMS, DEVICES AND METHODS

TECHNICAL FIELD

The subject matter disclosed herein relates generally high luminous output light fixture systems, devices, and methods. More particularly, the subject matter disclosed herein relates to multi-configurable, high luminous output light fixture systems, devices, and methods.

BACKGROUND

Solid state light devices, for example, light emitting diodes (LEDs) can be used in a variety products for indoor and outdoor commercial and industrial applications. For example, LEDs can illuminate building structures using high bay and low bay fixtures as well as illuminate street lights, billboards, parking lots, and parking garages. LEDs are desirable over conventional light sources for many reasons including, for example, a modular ability, increased energy efficiency, and a long L70 lifetime. Modular ability allows LEDs to be designed in fixtures whereby the LEDs can be easily manipulated, configured, and/or moved relative to each other or other components. Increased energy efficiency can lead to significant energy savings associated with lighting devices, while the long lifetime can result in low maintenance of hard to reach light fixtures, including high bay and low bay fixtures.

Conventional high bay and low bay fixtures, for example, utilize high-intensity discharge (HID) lamps which produce light by causing an electric arc between tungsten electrodes housed inside a translucent or transparent arc tube. Typically, light fixtures utilizing HID lamps are designed for use in either high bay applications or low bay applications, but not both. Conventional low bay fixtures are used where a ceiling height is between 15 and 25 feet, and high bay fixtures are used with ceiling heights of 20 to 40 feet. Light emission patterns and paths required for high bay and low bay fixtures can differ significantly, so it can be important to choose the right fixture when using HID lamps. Light fixtures utilizing HID lamps comprise materials which can adversely affect the environment, such as mercury and heavy metals. Further, HID lamps can potentially shatter or otherwise violently fail as a result of misapplication, system failure, or a variety of other factors. These failures can release extremely hot glass and lamp parts creating a risk of fire, personal injury, or property damage.

Consequently, there remains a need for improved high luminous output light fixtures and methods that overcome or alleviate shortcomings of prior art fixtures.

SUMMARY

In accordance with this disclosure, multi-configurable, high luminous output light fixture systems, devices, and methods are provided which are well suited for a variety of applications, including industrial and commercial lighting products. It is, therefore, an object of the present disclosure herein to provide novel multi-configurable, high luminous light fixture systems, devices, and methods comprising adjustable light devices while providing energy savings and requiring minimal maintenance.

These and other objects of the present disclosure as can become apparent from the disclosure herein are achieved, at least in whole or in part, by the subject matter disclosed herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1A:
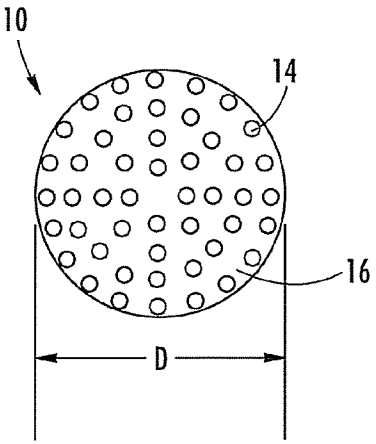
FIGS. 1A and 1B illustrate an embodiment of a light fixture according to the subject matter disclosed herein.

Reference will now be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

As illustrated in the various figures, some sizes of structures or portions are exaggerated relative to other structures or portions for illustrative purposes and, thus, are provided to illustrate the general structures of the present subject matter. Furthermore, various aspects of the present subject matter are described with reference to a structure or a portion being formed on other structures, portions, or both. As will be appreciated by those of skill in the art, references to a structure being formed "on" or "above" another structure or portion contemplates that additional structure, portion, or both may intervene. References to a structure or a portion being formed "on" another structure or portion without an intervening structure or portion are described herein as being formed "directly on" the structure or portion. Similarly, it will be understood that when an element is referred to as being "connected", "attached", or "coupled" to another element, it can be directly connected, attached, or coupled to the other element, or intervening elements may be present. In contrast, when an element is referred to as being "directly connected", "directly attached", or "directly coupled" to another element, no intervening elements are present.

Furthermore, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the device in addition to the orientation depicted in the figures. For example, if the device in the figures is turned over, structure or portion described as "above" other structures or portions would now be oriented "below" the other structures or portions. Likewise, if devices in the figures are rotated along an axis, structure or portion described as "above", other structures or portions would now be oriented "next to" or "left of" the other structures or portions. Like numbers refer to like elements throughout.

Light emitting devices according to embodiments described herein may comprise group III-V nitride (e.g., gallium nitride) based light emitting diodes (LEDs) or lasers fabricated on a silicon carbide substrate, such as those devices manufactured and sold by Cree, Inc. of Durham, N.C. For example, Silicon carbide (SiC) substrates/layers discussed herein may be 4H polytype silicon carbide substrates/layers. Other silicon carbide candidate polytypes, such as 3C, 6H, and 15R polytypes, however, may be used. Appropriate SiC substrates are available from Cree, Inc., of Durham, N.C., the assignee of the present subject matter, and the methods for producing such substrates are set forth in the scientific literature as well as in a number of commonly assigned U.S. patents, including but not limited to U.S. Pat. No. Re. 34,861, U.S. Pat. No. 4,946,547, and U.S. Pat. No. 5,200,022, the disclosures of which are incorporated by reference herein in their entireties.

As used herein, the term "Group III nitride" refers to those semiconducting compounds formed between nitrogen and one or more elements in Group III of the periodic table, usually aluminum (Al), gallium (Ga), and indium (In). The term also refers to binary, ternary, and quaternary compounds such as GaN, AlGaN and AlInGaN. The Group III elements can combine with nitrogen to form binary (e.g., GaN), ternary (e.g., AlGaN), and quaternary (e.g., AlInGaN) compounds. These compounds may have empirical formulas in which one mole of nitrogen is combined with a total of one mole of the Group III elements. Accordingly, formulas such as AlxGa1-xN where 1>x>0 are often used to describe these compounds. Techniques for epitaxial growth of Group III nitrides have become reasonably well developed and reported in the appropriate scientific literature, and in commonly assigned U.S. Pat. No. 5,210,051, U.S. Pat. No. 5,393,993, and U.S. Pat. No. 5,523,589, the disclosures of which are hereby incorporated by reference herein in their entireties.

Although various embodiments of LEDs disclosed herein comprise a substrate, it will be understood by those skilled in the art that the crystalline epitaxial growth substrate on which the epitaxial layers comprising an LED are grown may be removed, and the freestanding epitaxial layers may be mounted on a substitute carrier substrate or submount which may have better thermal, electrical, structural and/or optical characteristics than the original substrate. The subject matter described herein is not limited to structures having crystalline epitaxial growth substrates and may be used in connection with structures in which the epitaxial layers have been removed from their original growth substrates and bonded to substitute carrier substrates.

Group III nitride based LEDs according to some embodiments of the present subject matter, for example, may be fabricated on growth substrates (such as a silicon carbide substrates) to provide horizontal devices (with both electrical contacts on a same side of the LED) or vertical devices (with electrical contacts on opposite sides of the LED). Moreover, the growth substrate may be maintained on the LED after fabrication or removed (e.g., by etching, grinding, polishing, etc.). The growth substrate may be removed, for example, to reduce a thickness of the resulting LED and/or to reduce a forward voltage through a vertical LED. A horizontal device (with or without the growth substrate), for example, may be flip chip bonded (e.g., using solder) to a carrier substrate or printed circuit board (PCB), or wire bonded. A vertical device (without or without the growth substrate) may have a first terminal solder bonded to a carrier substrate or PCB and a second terminal wire bonded to the carrier substrate or PCB. Examples of vertical and horizontal LED chip structures are discussed by way of example in U.S. Publication No. 2008/θ258130 to Bergmann et al. and in U.S. Publication No. 2006/θ186418 to Edmond et al., the disclosures of which are hereby incorporated by reference herein in their entireties.

Figure 1B:
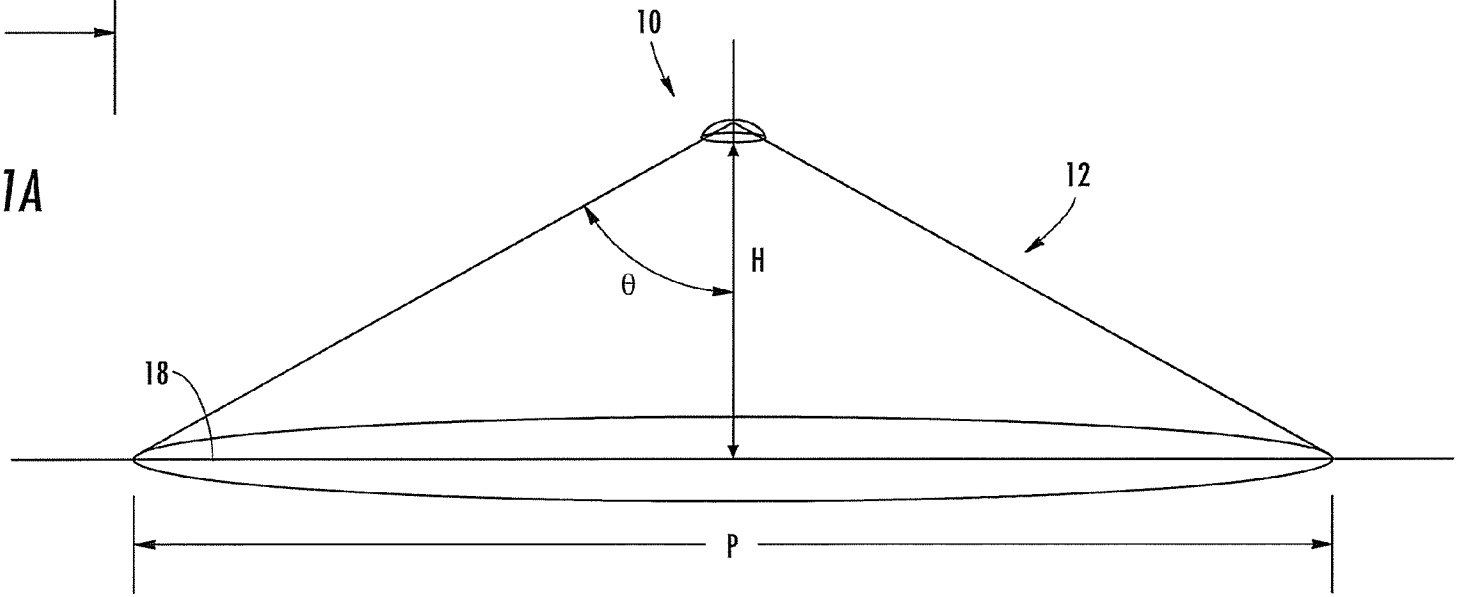

Referring now to FIGS. 1-14, FIGS. 1A to 3C illustrate the ability of light fixtures disclosed herein which can be manipulated, configured, and arranged to produce a desired light output. Light fixtures herein can comprise pedestal type lighting fixtures comprising one or more LEDs or groups of LEDs arranged at different angles, planes, and/or distances to achieve a desired light output. Portions of the light fixtures can comprise movable portions. For example, FIGS. 1A and 1B illustrate a light fixture, generally designated 10 with corresponding light pattern, generally designated 12. Light pattern 12 comprises a light path P and cutoff angle θ corresponding to a given light fixture 10. Cutoff angle θ can comprise any angle with respect from vertical at which a housing, reflector, or other shielding device within a light fixture 10 can cut off a percentage of direct visibility of the light source, for example, one or more LEDs. In one aspect, the light fixture 10 may not be directly shielded, but merely covered with a transparent material, such as, for example, transparent PLEXIGLAS®. In another aspect, light fixture 10 may be covered with a semi-transparent material comprising a diffuser. FIG. 1A illustrates light fixture 10 comprising a plurality of LEDs 14 forming a matrix upon a body 16 of light fixture 10. In one aspect, light fixture 10 can comprise a substantially circular body 16 having a given diameter D that can vary depending upon the application. As FIG. 1A illustrates, circular body 16 can be essentially flat, that is, one of the plurality of LEDs 14 is horizontal and not angled with respect to another one of the plurality. In one aspect, light fixture 10 can comprise a matrix of 48 LEDs 14 arranged on circular body 16 having a diameter D of approximately nine inches.

FIG. 1B illustrates light fixture 10 suspended above a surface that can for example be a flooring surface 18, for example, as it may be suspended from a ceiling or other structure in a high bay or low bay warehouse. Light path P and cutoff angle θ can essentially correspond to specific arrangements of the plurality of LEDs 14. The size and/or diameter of path P and cutoff angle θ can vary depending upon one or more factors not limited to, for example, a height H at which light fixture 10 is suspended from surface 18, the body 16 shape, the number, arrangement, and/or angle of LEDs 14, and the amount of power supplied to light fixture 10. Power can be supplied, for example, using a power supply (FIGS. 9, 12) which can comprise one or more constant current drivers supplying constant but adjustable current with variable voltage, depending on the number of LEDs. A suitable power supply can comprise a switch mode power supply. The power supply can further comprise an adjustable voltage range and the type of driver depends on a voltage drop of each of the LEDs 14 within light fixture 10. In one aspect, light fixture 10 can be suspended a height H of 23 feet above surface 18 and fixture 10 can be suitable for either a high bay or low bay fixture. Light pattern 12 produced by light fixture 10 can comprise a 50% cutoff angle θ equal to 60 degrees (60°) and comprise a length of 46 feet (twice H based on a 60° triangle). Therefore, light pattern 12 associated with light fixture 10 can comprise cutoff angle θ approximately 60° and path P approximately 80 feet. Path P can comprise a circle with a diameter of approximately 80 feet and a radius of approximately 40 feet.

Figure 2A:
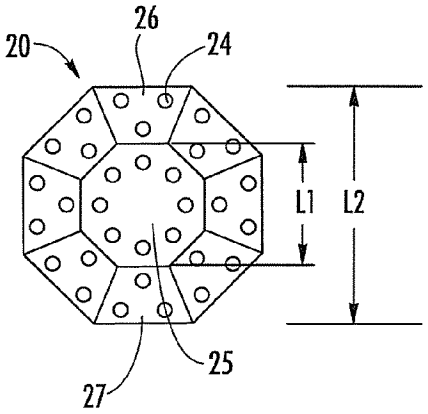
FIGS. 2A, 2B and 2C illustrate an embodiment of a light fixture according to the subject matter disclosed herein.
Figure 2B:
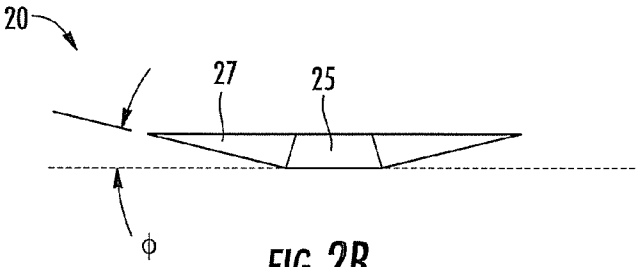
Figure 2C:
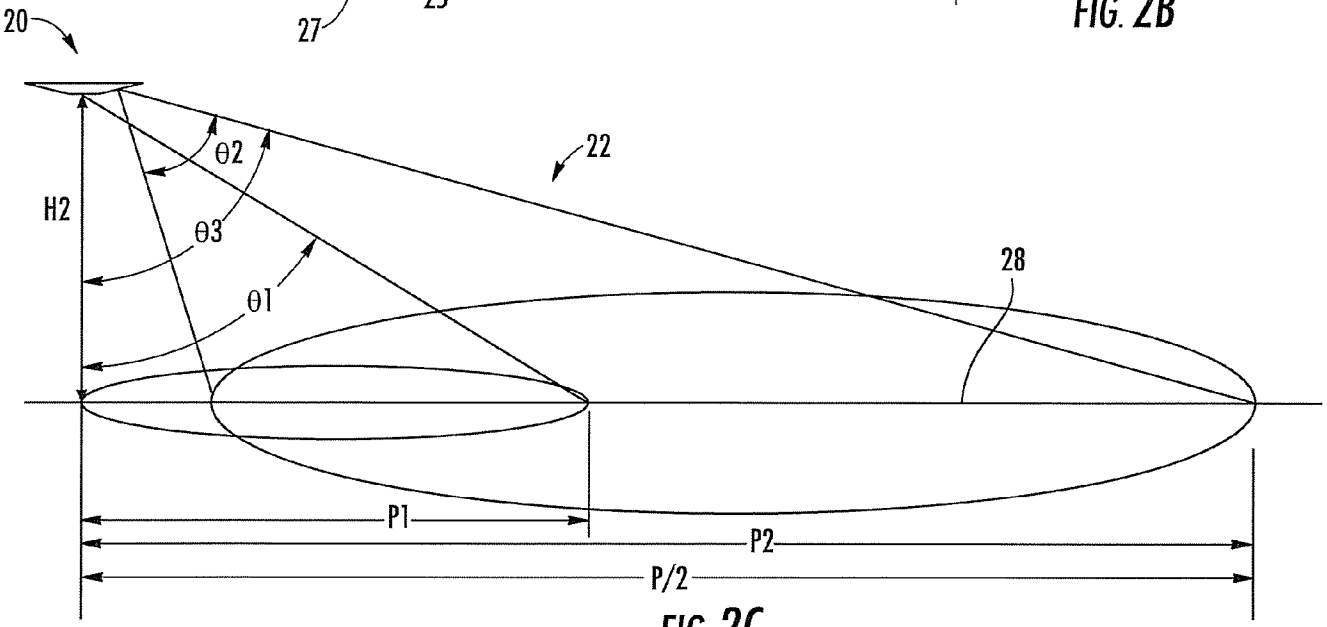

FIGS. 2A to 2C illustrate an alternative embodiment of a light fixture, generally designated 20, and corresponding light pattern, generally designated 22. For illustration purposes, light pattern 22 is shown as half of an overall light pattern. For example, the other half of overall light pattern can be symmetrically disposed adjacent H2 and opposing light pattern 22. Light pattern 22 comprises a light path, designated P/2, which can represent half of an overall light path. Light pattern 22 further comprises first and second cutoff angles θ1 and θ2, respectively.

First cutoff angle θ1 can correspond to a light source arranged on a first body portion 25 of light fixture 20 and second cutoff angle θ2 can correspond to a light source arranged on a second body portion 27 of light fixture 20. A third angle θ3 exists and can correspond to an increase in offset caused by angling second body portion 27 with respect to first body portion 25. For example, light fixture 20 can comprise a plurality of LEDs 24 arranged in a matrix and located upon a substantially octagonal shaped body 26. Body 26 can comprise any size and/or shape desired. Body 26 can comprise first body portion 25 and second body portion 27. In one aspect, light fixture 20 can comprise 32 LEDs 24 arranged on body 26. That is and for example, a total of eight LEDS can be arranged on first body portion 25 and a total of 24 LEDS 24 can be arranged on second body portion 27 of light fixture 20. In one aspect, second body portion 27 can essentially surround a perimeter of first body portion 25. First body portion 25 can further comprise a first length L21, or diameter and second body portion 27 can comprise a second length L2, or second diameter wherein first length L1 can be smaller than second length L2. In one aspect first body portion 25 can comprise first length L1 of approximately six inches and second body portion 27 can comprise second length L2 of approximately 12 inches.

As FIG. 2B illustrates, second body portion 27 and therefore LEDs 24 arranged on second body portion 27 can be selectively angled an angle Φ with respect to first body portion 25. That is, first body portion 25 can comprise a substantially horizontal portion having one or more LEDs 24 arranged thereon. Second body portion 27 can comprise an angled portion having one or more LEDs 24 arranged thereon. Second body portion 27 can be pre-configured at a specific angle or can be selectively angled by an end user. One or more LEDs 24 arranged on second body portion 27 can be located at angle Φ with respect to one or more LEDs 24 on first body portion 25. In one aspect, angle Φ comprises 15 degrees (15°). In other aspects, second body portion 27 can be configured at any angle Φ with respect to first body portion 25. One or more LEDs 24 arranged upon second body portion 27 can be angled at any angle Φ with respect to one or more LEDs 24 arranged upon first body portion 25 and can comprise a range from 0 to 180°.

As FIG. 2C illustrates, manipulating light fixture 20 such that LEDs 24 arranged on second body portion 27 can be configured at an angle Φ with respect to LEDs 24 arranged on first body portion can affect light pattern 22. For example, light pattern 22 can have greater emission and a light path P/2 of a greater distance than that illustrated by FIG. 1B. Light pattern 22 can comprise first cutoff angle θ1 corresponding to one or more LEDs 24 arranged on first body portion 25 of light fixture 20 and second cutoff angle θ2 corresponding to one or more LEDs 24 arranged on second body portion 27 of light fixture 20. Light fixture 20 can be suspended above a surface 28, such as a floor of a high bay or low bay warehouse, such that first body portion 25 is positioned at a height H2 above surface 28. LEDs 24 on first body portion 25 of light fixture can correspond to a first portion of light pattern 22 comprising height H2, first path P1, and first cutoff angle θ1. First body portion 25 can comprise similar features taught by FIGS. 1A and 1B. That is, in one aspect, first body portion 25 can be positioned a height H2 of 23 feet above surface 28. First body portion 25 of light fixture 20 can comprise a horizontal portion with a 50% first cutoff angle θ1 of 60° comprising a length of 46 feet (twice H2 based on a 60° triangle). Therefore, first portion of light pattern 22 associated with light fixture 20 can comprise first cutoff angle θ1 approximately 60° and first path P1 approximately 40 feet.

Still referring to FIG. 2C, light path 22 can comprise a second portion corresponding to LEDs 24 arranged thereon. Second body portion 27 of light fixture 20 can correspond to a second portion of light pattern 22 comprising second path P2 and second cutoff angle θ2. In one aspect, second portion of light pattern 22 can comprise second cutoff angle θ2 approximately 60°. In one aspect, the extended path P2 of light pattern 22 corresponds to a third angle θ3. In one aspect, θ3 can be approximately 75°, that is, it corresponds to θ1 of 60° plus angle Φ of 15° at which second body portion 27 can be positioned with respect to first body portion 25. In one aspect, path P2 can comprise approximately 85 feet, at least a portion of which overlaps with P1. The summation of path lengths P1 and P2 comprises P/2, or half of an overall light pattern. The light fixtures disclosed herein are thus configurable by angling one or more portions and/or components within the light fixture to achieve a variety of light patterns. The light patterns can comprise variable path lengths and cutoff angles rendering the fixtures suitable for use in both high and low bay fixture applications.

Figure 3B:
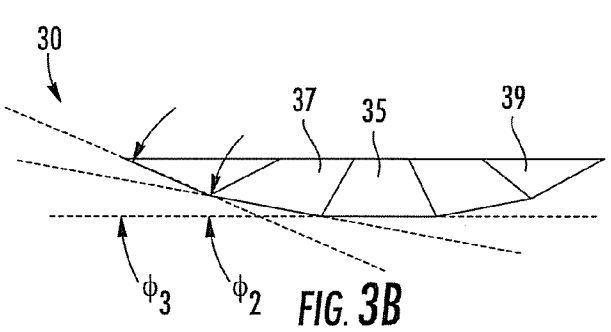
FIGS. 3A, 3B and 3C illustrate an embodiment of a light fixture according to the subject matter disclosed herein.
Figure 3A:
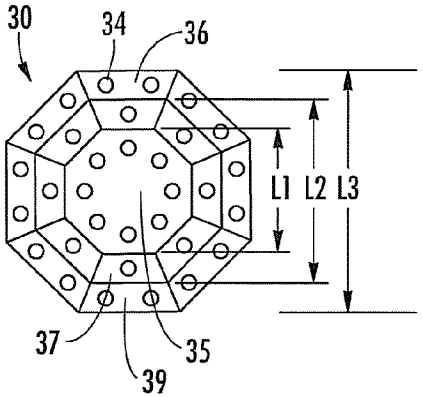
Figure 3C:
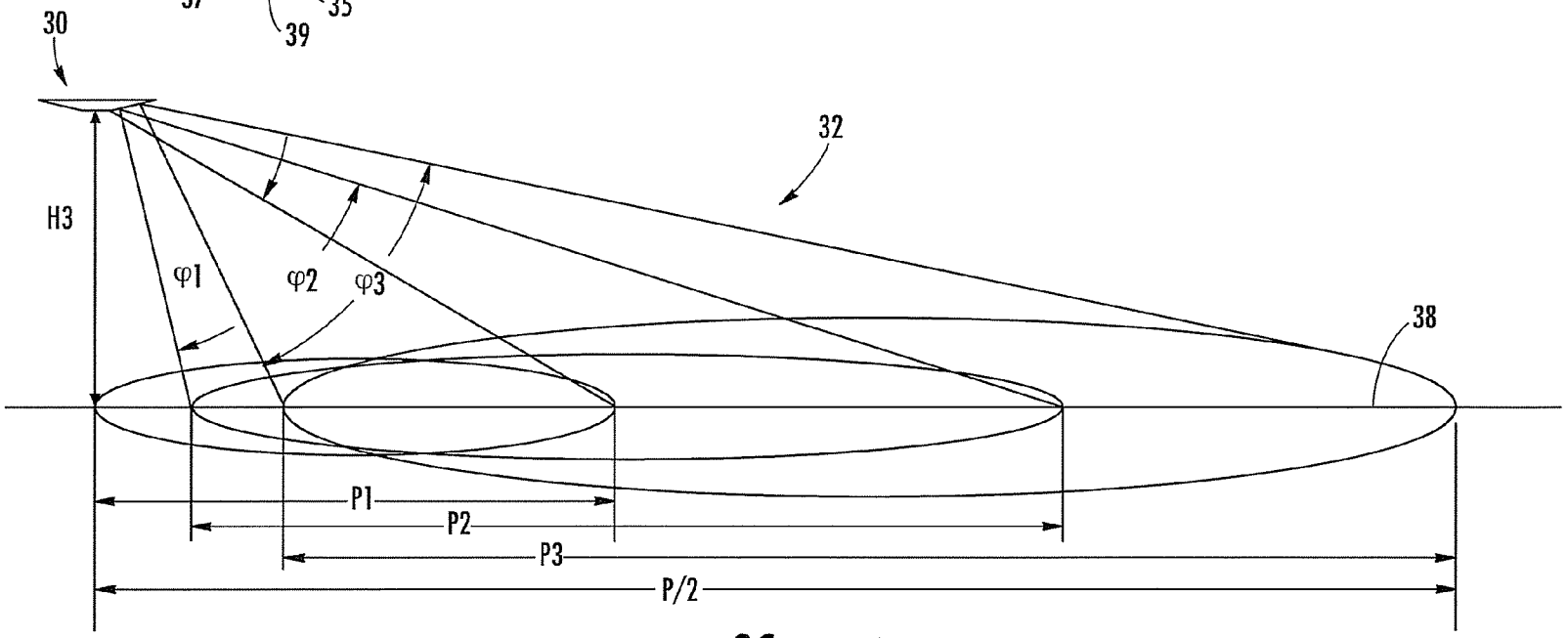

FIGS. 3A to 3C further illustrate an embodiment of a light fixture, generally designated 30 comprising a corresponding light pattern, generally designated 32. For illustration purposes light pattern 32 is shown as approximately half of an overall light pattern, the overall light pattern having a symmetric pattern adjacent a light path P/2. For example, the other half of overall light pattern can be symmetrically disposed adjacent H3 and opposing light pattern 32. Light pattern 32 can comprise light path P/2 and first, second, and third cutoff angles Φ1, Φ2, and Φ3, respectively. First cutoff angle Φ1 can correspond to one or more light sources arranged on a first body portion 35 of light fixture 30. Second cutoff angle Φ2 can correspond to one or more light sources arranged on a second body portion 37 of light fixture 30. Likewise, third cutoff angle Φ3 can correspond to one or more light sources arranged on a third body portion 39 of light fixture 30. For example, light fixture 30 can comprise a plurality of LEDs 34 arranged in a matrix and located upon a substantially octagonal shaped body 36. Body 36 can comprise any size and/or shape desired. Body 36 can comprise first body portion 35, second body portion 27, and third body portion 39. In one aspect, light fixture 30 can comprise a matrix of 32 total LEDs 34 arranged thereon. That is, eight LEDS 34 can be arranged on first body portion 35, eight LEDS 34 can be arranged on second body portion 37, and 16 total LEDs 24 can be arranged on third body portion 39 of the light fixture 30. In one aspect, second body portion 37 can at least essentially surround a perimeter of first body portion 35 and third body portion 39 can at least essentially surround a perimeter of second body portion 37. First body portion 35 can comprise a first length L1, or diameter, second body portion 37 can comprise a second length L2, or second diameter, and third body portion 39 can comprise a third length L3 or third diameter. First length L1 can be smaller than both second and third lengths L2 and L3, respectively, and second length L2 can be smaller than third length L3. In one aspect, first body portion 35 can comprise first length L1 of approximately six inches, second body portion 37 can comprise second length L2 of approximately nine inches, and third body portion 39 can comprise third length L3 of approximately 12 inches.

As FIG. 3B illustrates, second and third body portions 37 and 39, respectively, can be angled at various locations with respect to first body portion 35. That is, first body portion 35 can comprise a substantially flat, horizontal body portion having one or more LEDs 24 arranged thereon. Second body portion 37 can be located an angle Φ2 with respect to first body portion 35. Third body portion 39 can be angled with respect to each of first and second body portions 35 and 37, respectively. For example, third body portion 39 can be located an angle Φ3 from respective first body portion 35. One or more LEDs 34 can be arranged on first, second, and third body portions 35, 37, and 39, respectively. Thus, LEDs 34 arranged on second body portion 37 can be located at angle Φ2 with respect to one or more LEDs 34 on first body portion 35, and LEDS 34 arranged on third body portion 39 can be located an angle Φ3 with respect to one or more LEDS 34 on first body portion 35. In one aspect, angle Φ2 comprises 10 degrees (10°) and angle Φ3 comprises 25 degrees (25°). That is, third portion 39 can be positioned a greater angle away from horizontal and first body portion 35 than angle Φ2 between first body 35 and second body portions 37. In other aspects, third body portion 39 and second body portion 37 can be configured at any angles Φ2 and Φ3 with respect to first body portion 35. In one aspect, angle Φ3 comprises a range from 0 to 180° and angle Φ2 comprises a range less than Φ3, therefore less than 180°.

As FIG. 3C illustrates, configuring second and third body portions 37 and 39, respectively at angles Φ2 and Φ3 with respect to first body portion 35 can affect light pattern 32. For example, light pattern 32 can comprise first cutoff angle ϕ1 corresponding to one or more LEDs 34 arranged on first body portion 35 of light fixture 30. Likewise, second and third cutoff angles ϕ2 and ϕ3, respectively, can correspond to one or more LEDs 34 arranged on second and third body portions 37 and 39, respectively. Light fixture 30 can be suspended above a surface 38, such as a floor of a high bay or low bay warehouse, such that first body portion 35 is positioned at a height H3 above surface 38. A first portion of light pattern 32 can comprise height H2, first path P1, and first cutoff angle ϕ1. First body portion 35 can comprise similar features taught by FIGS. 1A to 1B, that is, in one aspect, first body portion 35 can be positioned a height H3 of 23 feet above surface 38. First body portion 35 of light fixture 30 can comprise a substantially flat, horizontal portion with a 50% first cutoff angle ϕ1 of 60° having a length of 46 feet (twice H3 based on a 60° triangle). Therefore, first portion of light pattern 32 associated with light fixture 20 can comprise first cutoff angle ϕ1 approximately 60° and first path P1 approximately 40 feet.

Still referring to FIG. 3C, light path 32 can comprise second and third portions corresponding to LEDs 34 arranged on second and third body portions 37 and 39, respectively. Second body portion 37 of light fixture 30 can correspond to a second portion of light pattern 32 comprising a second path P2 and second cutoff angle ϕ2. Likewise, third body portion 39 can correspond to a third portion of light pattern 32 comprising a third path P3 and second cutoff angle ϕ3. In one aspect, cutoff angles ϕ1, ϕ2, and ϕ3 can each comprise 60°, and the angle between each portion with variable cutoff angles can at least essentially correspond to Φ2 and Φ3. In one aspect, paths P1, P2, and P3 can overlap, and the summation of path lengths P1, P2, and P3 can equal light path P/2 comprising half of an overall light pattern. Path P/2 of FIG. 3C can equal a greater length than path P/2 of FIG. 2C and path P of FIG. 1B. This illustrates the configurable nature of light fixtures disclosed herein, and the effect that angling and/or arranging LEDs upon one or more body portions results in a variety of light patterns varying in path lengths and cutoff angles. This ability rendering the fixtures disclosed herein suitable for use in both high bay and low bay fixture applications as a user could make a light pattern as large or as small, as necessary.

Figure 4A:
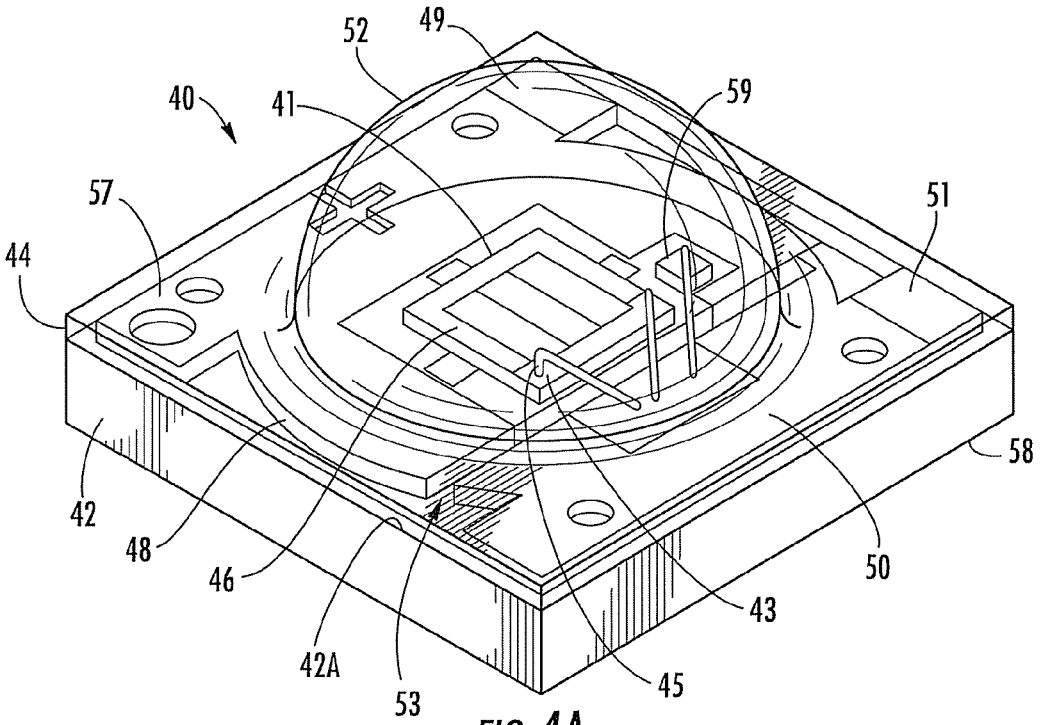
FIGS. 4A and 4B illustrate an embodiment of a light emitting diode (LED) package for use in light fixtures according to the subject matter disclosed herein.
Figure 4B:
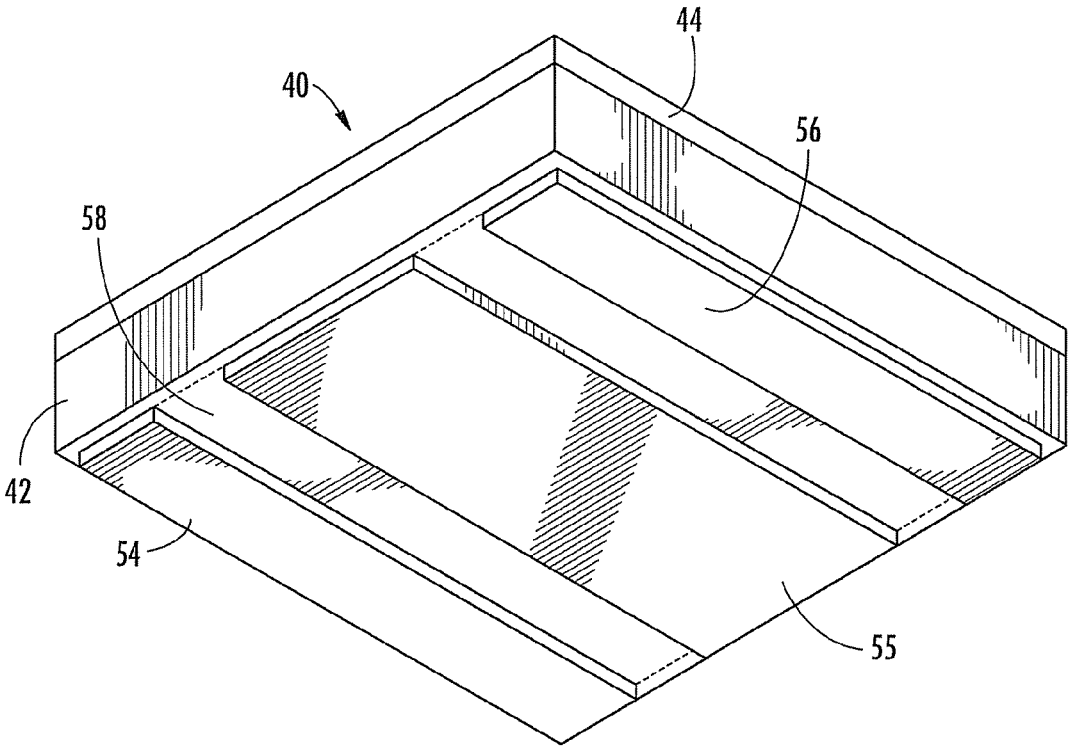

Light fixtures disclosed herein require light sources such as, for example LED packages comprising one or more LED chips. FIGS. 4A to 4B illustrate top and bottom perspective views of one embodiment of an LED package, generally designated 40. LED package 40 can serve as the light source for light fixtures described herein. A variety of LED packages can be suitable for use in light fixtures described herein, but for illustration purposes, one package is illustrated. In one aspect LED package 40 can comprise a body formed using low temperature co-fired ceramic (LTCC) materials. In other aspects, LED package 40 can comprise a body manufactured using any suitable technology known in the art now or in the future, including but not limited to a plastic leaded chip carrier (PLLC) body molded about lead portions from a leadframe. LED package body can comprise an electrically insulating material. FIGS. 4A to 4B illustrate one embodiment of an LED package 40 according to the subject matter herein generally comprising a substrate or a submount 42 having one or more LEDs 46 emitting same or different colors. In the embodiment shown, a single LED 46 can mount over submount 42. LED 46 can comprise many different semiconductor layers arranged in a plurality of different ways. LED structures and their fabrication and operation are generally known in the art and only briefly discussed herein. The layers of LED 46 can be fabricated using known processes with a suitable process being fabrication using metal organic chemical vapor deposition (MOCVD). The layers of LEDs 46 can generally comprise an active layer/region sandwiched between first and second oppositely doped epitaxial layers all of which are formed successively on a growth substrate.

As FIG. 4A illustrates, LED 46 can comprise a conductive current spreading structure 41 and one or more wire bond pads 43 on its top surface, both of which can comprise a conductive material and can be deposited using suitable technology and methods. Current spreading structure 41 and bond pads 43 can comprise, for example, Au, Cu, Ni, In, Al, Ag and/or combinations thereof, conducting oxides and/or transparent conducting oxides. Current spreading structure 41 generally comprises an arranged grid on a surface of LED 46 with one or more fingers spaced to enhance current spreading from the bond pads 43 into the LED's top surface. In operation, an electrical signal or current can be applied to wire bond pads 43, such as by electrically connecting LED 46 using a wire bond 45 to one or more electrical elements. The electrical signal can spread through current spreading structure 41 and into the top surface of LED 46. Current spreading structures can be used in LEDs where the top surface is p-type, but can also be used for n-type materials.

LED 46, for example, can optionally be coated with one or more phosphors with the phosphors absorbing at least a portion of the LED light and emitting a different wavelength of light such that the LED 46 emits a combination of light from the LED and the phosphor. In one aspect, the LED 46 emits a white light combination of LED and phosphor light. The LED 46 can be coated and fabricated using many suitable methods. LED packages can also have multiple LEDs of different colors, one or more of which may be white emitting.

Still referring to FIGS. 4A and 4B, submount 42 can comprise, for example, an electrically insulating material. Suitable materials can comprise, for example and without limitation, ceramic materials such as aluminum oxide, aluminum nitride or organic insulators like polyimide (PI) and polyphthalamide (PPA). In other aspects, submount 42 can comprise a printed circuit board (PCB), sapphire or silicon or any other suitable material. The size of submount 42 in package 40 can vary depending on different factors, with one being the size of LED 46. Submount 42 can have a top surface 42A comprising patterned conductive features, for example, a die attach pad 48 with an integral first contact pad 49. Top surface 42A can also comprise a second pad 50 comprising an integral second contact pad 51. LED 46 can mount approximately center of attach pad 48. The patterned conductive features provide conductive paths for electrical connection to LED 46 using known contacting methods. LED 46 can mount to attach pad 48 using any suitable method and material, for example, conventional solder materials that may or may not contain a flux material or dispensed polymeric materials that may be thermally and electrically conductive. Attach pad 48 and first and second contact pads 49, 51 can comprise different materials, for example, metals or other conductive materials.

As illustrated by FIG. 4A, a gap 53 can exist between second pad 50 and attach pad 48 down to top surface 42A of submount 42, with gap 53 providing electrical isolation between attach pad 42 and second pad 50. An electrical signal, for example, electrical current can be applied to LED 46 through the second contact pad 51 and first contact pad 49, with the electrical signal on first pad 49 passing directly to LED 46 through attach pad 48 and the signal from second pad 50 passing into LED 46 through wire bonds. Gap 53 can provide electrical isolation between second pad 50 and attach pad for preventing shorting of the electrical signal applied to LED 46.

FIG. 4B illustrates LED package 40 arranged for mounting using surface mount technology having internal conductive paths. As previously mentioned, the light fixtures herein are not limited to light package 40 but can comprise any suitable light source utilizing any suitable technology. For example, package body is not limited to surface mount technology or the package shown. Other embodiments are contemplated, but for illustration purposes have not been shown. LED package 40 can comprise first and second surface mount pads 54, 56 that can be formed on a bottom surface 58 of submount 42, the surface mount pads 54, 56 at least partially in alignment with first and second contact pads 49, 51, respectfully. Internal elements, such as conductive vias (not shown) can form through submount 42 between first mounting pad 54 and first contact pad 49, such that when a signal is applied to first mounting pad 54 it can also be conducted to first contact pad 49. Similarly, conductive vias can form between second mounting pad 56 and second contact pad 51 (integral with second pad 50) to conduct an electrical signal between the two. First and second mounting pads 54, 56 allow for surface mounting of LED package 40 with the electrical signal to be applied to the LED 46 applied across the first and second mounting pads 54, 56. Mounting pads 54, 56 can comprise any suitable material and method of formation. For example, mounting pads 54, 56 can comprise methods and materials similar to those used for attach and pads 48, 49, 50, and 51.

Referring to FIG. 4A, package 40 can comprise a solder mask 57 comprising any suitable material disposed over top surface 42A of submount 40. Solder mask 57 can at least partially covering attach pad 48, second pad 50 and their respective integral first and second contact pads 49 and 50. Solder mask 57 can also at least partially cover gap 53. Solder mask 57 can protect these features during subsequent processing steps and in particular mounting LED 46 to the attach pad 48 and wire bonding. During these steps there can be a danger of solder or other materials depositing in undesired areas, which can result in damage to the areas or result in electrical shorting. The solder mask serves as an insulating and protective material that can reduce or prevent these dangers. The solder mask comprises an opening for mounting LED 46 to attach pad 48 and for attaching wire bonds to second pad 50. Solder mask 57 can also comprise openings allowing convenient electrical access to the contact pads 49, 51 for testing the package 40 during fabrication. Solder mask 57 can also comprise alignment holes, symbols, and indicators that provide for alignment and/or indication of electrical properties of package 40 and also allow for alignment when mounted in place by an end user. Indicators can comprise illustrations of which side of the LED package 40 should be coupled to the plus or minus of the signal to be applied to the package. This can ensure accurate mounting of LED package 40 to a PCB or other fixture, whether by machine or hand. In the embodiment shown, an indicator comprises a plus (+) sign over the first contact pad 49, indicating that package 40 should be mounted with the positive of the signal coupled to first mounting pad 54. The minus of the signal would then be coupled to second mounting pad 56. It is understood that many different symbol types can be used and that a symbol can also be comprised over second conductive pad 51. It is also understood that the symbols can be placed in other locations other than solder mask 57.

Package 40 can also comprise elements for protecting against damage from electrostatic discharge (ESD). In the embodiment shown the elements are on-chip, and different elements can be used such as various vertical silicon (Si) Zener diodes, different LEDs arranged in parallel and reverse biased to the LED 46, surface mount varistors and lateral Si diodes. In one aspect, a Zener diode 59 can be utilized and mounted to attach pad 48 using any suitable mounting techniques. The diode 59 can be relatively small so that it does not cover an excessive area on the surface of submount 42. In some embodiments, ESD elements can be external to LED package 40.

In many light sources, for example, LED package 40, heat typically does not spread efficiently into the submount 42, particularly those comprising ceramic or similar materials. For example, when LED 46 is provided on attach pad 48 that extends generally only under the LED, heat does not spread through most of the submount 42 and is generally concentrated to the area just below LED 46. This can cause overheating of LED 46 which can limit the operating power level for LED package 40. Thus, to improve heat dissipation in LED package 40, the one or more pads 48, 49, 50, 51 provide extending thermally conductive paths to laterally conduct heat away from LED 46 such that it can spread to other areas of the submount beyond the areas just below LED 46. Attach pad 48 can cover more of the surface of submount 42 than LED 46, with the attach pad extending from the edges of LED 46 toward the edges of submount 42. In one aspect, attach pad 48 can comprise a generally circular body extending radially.

LED package 40 can further comprise a metalized area 55 on bottom surface 58 of submount 42, optionally disposed between first and second mounting pads 54, 56. Metalized area 55 can comprise a thermally conductive material and in one aspect, can be at least partially vertically aligned with LED 46. In one embodiment, metalized area 55 is not in electrical contact with elements on top surface 42A of submount 42 or first and second mounting pads 54, 56 on bottom surface 58 of submount 42. Although heat from LED 46 can laterally spread over the top surface of the submount by attach pad 48 and pads 49, 50 more heat can pass into submount 42 directly below and around LED 46. Metalized area 55 can assist with this dissipation by allowing heat to spread into metalized area 55 where it can dissipate from the package more readily. It is also noted that heat can conduct from the top surface of submount 42, through one or more vias (not shown) where the heat can spread into first and second mounting pads 50, 52 where it can also dissipate. In one aspect, the thickness of metalized area 55 and first and second mounting pads 54, 56 can be approximately the same such that all three make contact to an external lateral surface such as a PCB or light fixture component. Metallized area 55 can comprise any size and shape suitable to assist with the dissipation of heat by allowing the heat to spread where it can dissipate to an external source or substrate, for example a PCB or metal core printed circuit board (MCPCB) and heat sink.

FIG. 4A further illustrates an optical element or lens 52 that can be formed over LED package 40 and top surface 42A of submount 42 and over LED 46, to provide both environmental and/or mechanical protection. Lens 52 can comprise different locations over package 40. In one aspect, lens 52 can be located as shown with LED 46 at approximately the center of a lens base. In some embodiments, the lens can be formed in direct contact with LED 46 and the top surface 42A of submount 42. In other embodiments there may be an intervening material or layer between the LED 46 and/or top surface 42A. Direct contact to LED 46 can provide certain advantages such as improved light extraction and ease of fabricating.

Lens 52 can be molded using different molding techniques and the lens can comprise any suitable shape depending on the desired shape of the light output. One suitable shape as shown is hemispheric, with some examples of alternative shapes being ellipsoid bullet, flat, hex-shaped, square and/or combinations thereof. Many different materials can be used for lens 52 such as silicones, plastics, epoxies or glass, with a suitable material being compatible with molding processes. Silicone is suitable for molding and provides suitable optical transmission properties. It can also withstand subsequent reflow processes and does not significantly degrade over time. It is understood that lens 52 can also be textured to improve light extraction or can contain materials such as phosphors or scattering particles.

As further illustrated in FIGS. 4A and 4B, LED package 40 can comprise a protective layer 44 covering top surface 42A of submount 42 and optionally disposed between lens 52 and an edge of submount 42. Protective layer 44 can provide additional protection to the elements on the top surface to reduce damage and contamination during subsequent processing steps and use. Protective layer 44 can be formed during formation of the lens 52 and can comprise the same material as lens 52. It is understood, however, that the LED package 40 can also be provided without the protective layer 44.

Figure 5:
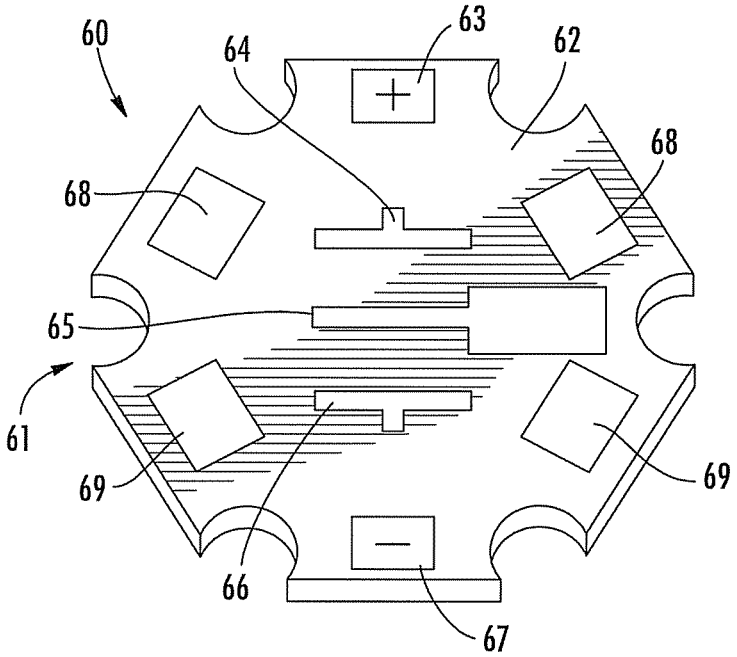
FIG. 5 illustrates a substrate for use in light fixtures according to the subject matter disclosed herein.

FIG. 5 illustrates a mounting substrate, generally designated 60, to which LED package 40 can be mounted within light fixture systems and devices disclosed herein. Substrate 60 can comprise, for example, any external substrate known in the art, such as, for example, a star shaped MCPCB substrate. Star shaped MCPCB substrate typically comprise a central core comprised of metal, typically an aluminum, copper, or iron alloy, as well as one or more electrically conductive layers to supply current to LED package 40 or chip. The electrically conductive layers can be electrically isolated from each other and/or metal core. The metal core can dissipate heat to an external heat sink. Substrate 60 can be an intermediate substrate located above or below other components within light fixture systems and devices. Substrate 60 can comprise a body 62 upon which LED package 40 can attach, mount, and/or engage. LED package 40 can attach to substrate 60 using, for example, solder technology or any other suitable attachment method known in the art. For example, first and second electrical pads 54 and 56 (shown best in FIG. 4B), respectively, can solder to and electrically couple with corresponding first and second deposited layers 64 and 66, respectively. First and second deposited layers 64 and 66 can comprise an electrically conductive material such as a thin metal film deposited upon an upper surface of substrate 60. Likewise, heat transfer material 55 can attach to and thermally couple with intermediate heat transfer layer 65 using solder or other attachment methods known in the art. Heat transfer layer 65 can comprise a thin film of thermally conductive material, such as a thin metal film.

Still referring to FIG. 5, substrate 60 can comprise one or more internal, electrically conductive layers which can internally electrically link first and second layers 64 and 66, respectively, to other components within the substrate body 62. For example, first deposited layer 64 can electrically and internally couple to one or more first circuit components 68. First circuit components 68 can comprise electrically conductive material electrically coupled with an anode 63 or a cathode 67 for supplying power to LED package 40. Here for example, first circuit components 68 are designated by the "+" sign at anode 63. Second deposited layer 66 can electrically couple, or link, to one or more second circuit components 69 which are also associated with the anode or cathode; here for example, second circuit components 69 are designated by the "−" sign at cathode 67. First and second circuit components 68 and 69 can provide an alternative area for attaching to LED packages 40 if, for example, packages comprise external lead portions rather than electrical portions extending from a bottom surface of package body.

When first and second pads 54 and 56 are soldered, or otherwise electrically coupled, to the first and second deposited layers 64 and 66, respectively, electric current can be supplied through body 42 of LED package 40 and into LED chip 46, thereby illuminating LED chip 46. A bottom surface 65 of substrate 60 can attach using adhesive and/or solder technology, or other attachment methods known in the art, to other light fixture components as described herein. For example, bottom surface 65 of substrate 60 can attach to a light fixture component by way of a thermally conducting adhesive. In one aspect, substrate 60 can attach to a thermally conducting element of a light fixture to dissipate heat away from LED package 40 to increase brightness and improve reliability of LED package 40. One or more substrates 60 can connect in series and illuminate one or more LED packages 40 when anode 63 of one substrate electrically connects to cathode 67 of an adjacent substrate 60.

Figure 6A:
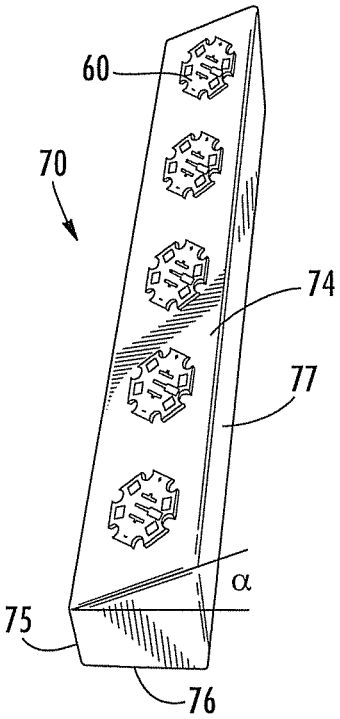
FIGS. 6A and 6B illustrate components of configurable light fixtures according to the subject matter disclosed herein.
Figure 6B:
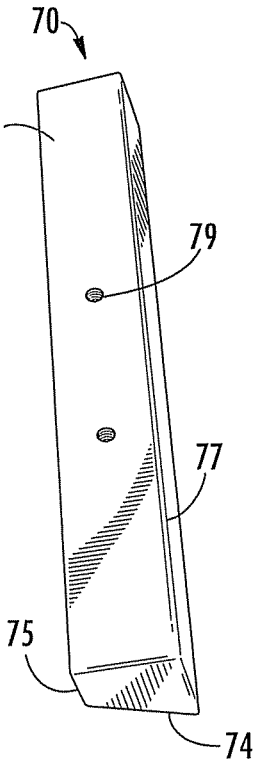

Referring now to FIGS. 6A and 6B, an example of an adjustable light fixture component or insert, generally designated 70, is illustrated. Adjustable light fixture component or insert 70 can comprise a body portion of a given light fixture formed integral or as a separate portion of the light fixture. Insert 70 can comprise an upper surface 74 and a bottom surface 76. One or more substrates 60 can attach to upper surface of insert 70 using a thermally conductive adhesive paste, solder technology, or any other attachment method known in the art. One or more LED packages 40 can mount upon one or more substrates 60 as previously described for providing light sources for the light fixture. Insert 70 can serve as an external heat sink from which heat may dissipate away from the LED chip 46 (FIG. 4A). Heat can travel in a path from the LED chip 46, through body 42 of LED package 40, into substrate 60 and into the body of insert 70. Insert 70 can comprise any suitable thermally conducting material, for example aluminum, aluminum alloy, or other metal and/or metal alloy. Inserts 70 can serve as a heat sink to dissipate heat in addition to angling or arranging LEDs 46. Further, insert 70 can comprise any suitable size, shape, configuration, or internal structure desired. For example, inserts 70 can comprise a solid or hollow structure, a structure having one or more voids or holes, or a structure containing electrical traces and/or conductive vias for conducting heat and/or electric current as appropriate.

FIGS. 6A and 6B illustrate bottom surface 76 of insert 70 as substantially flat and horizontal. Top surface 74 can form at an angle $\alpha$ with respect to horizontal bottom surface 76. In one aspect, angle $\alpha$ can comprise an angle greater than 10°. In another aspect, angle $\alpha$ can comprise a range from 10° to 25°. These ranges are not limiting, however, as in fact angle $\alpha$ can comprise any angle equal to or greater than zero with respect to horizontal bottom surface 76 depending on the application and desired pattern of light output per light fixture. That is, inserts 70 may or may not comprise angle $\alpha$, in some aspects, upper surface 74 can be disposed parallel to bottom surface 76. Inserts can be pre-configured or custom designed with respect to angle $\alpha$. No matter the angle $\alpha$, inserts 70 can be adjustable, configurable, and/or movable within a light fixture to obtain a desired light emission pattern and path.

FIGS. 6A and 6B further illustrate first and second lateral walls 75 and 77, respectively. First lateral wall 75 can be dimensionally smaller in length than second lateral wall 77. The degree of offset in length between the first and second lateral walls 75 and 77 depends on angle $\alpha$ at which upper surface 74 is offset from horizontal bottom surface 76. FIG. 6B also illustrates one or more bored holes 79 formed in bottom surface 76 of insert 70. Bored holes 79 enable inserts 70 to be configurable and slidably movable within a light fixture. For example, one or more fastening devices, for example, screws (not shown) can be inserted and threadingly engage bored holes 79. Insert 70 can be secured to a surface of a light fixture thereby fixedly engaged within the fixture, or insert can be loosened such that insert 70 is slidable within the fixture.

Figure 7:
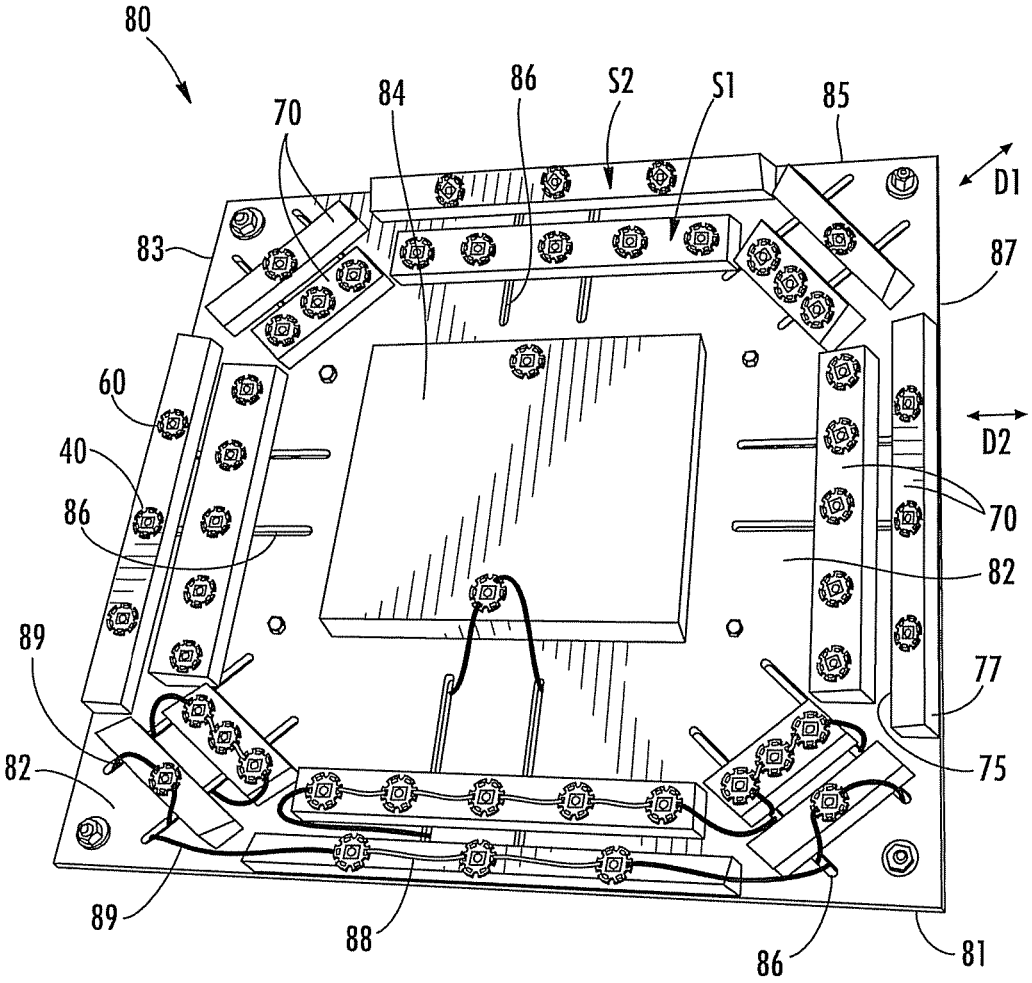
FIG. 7 illustrates an embodiment of a light fixture according to the subject matter disclosed herein.
Figure 8:
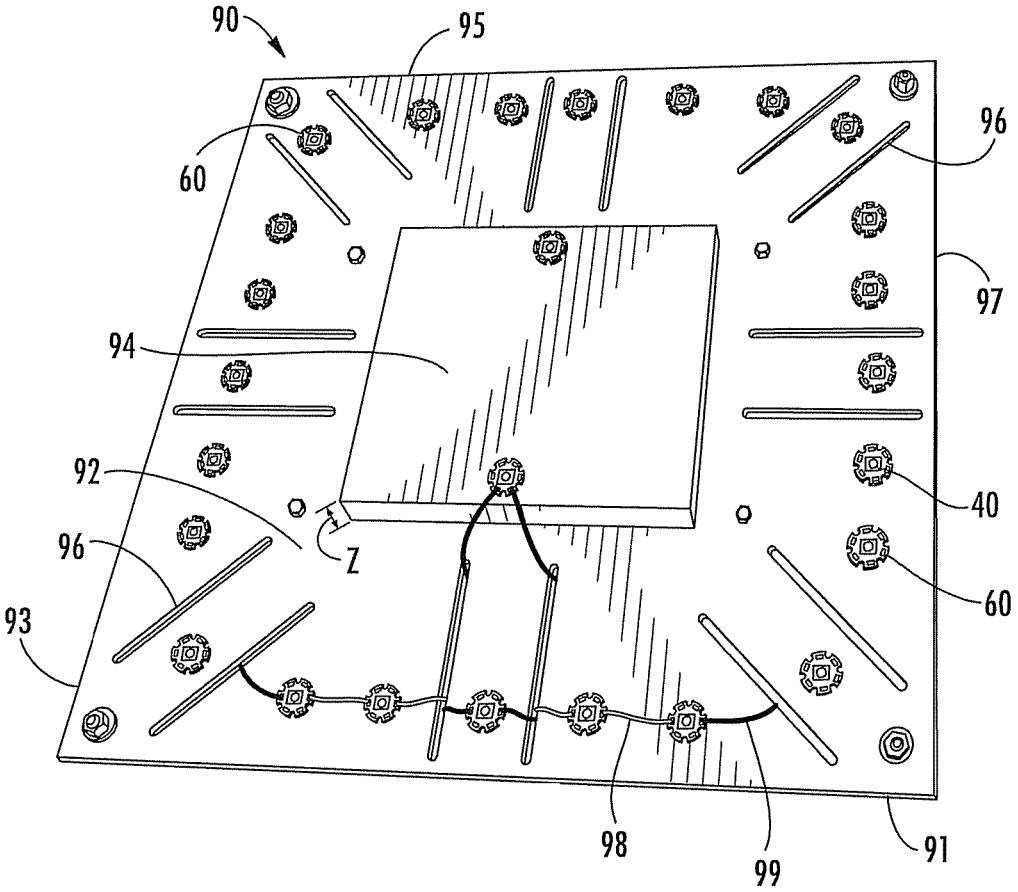
FIG. 8 illustrates an embodiment of a light fixture according to the subject matter disclosed herein.

FIGS. 7 and 8 illustrate perspective top views of embodiments of light fixture systems and devices. FIGS. 7 and 8 disclose light devices comprising a first body portion comprising a first group of one or more LEDs and a second body portion comprising a second group of one or more LEDs arranged thereon. Body portions can comprise a fixture plate, a central or elevated portion and/or adjustable insert portions, the insert portions configurable to optionally form sectional rings. The body portions can be movable with respect to each other such that variable light emission patterns can be achieved. FIG. 7 illustrates a first embodiment of light fixture, generally designated 80. Light fixture 80 comprises fixture plate 82 to which a platform that can be a central or elevated platform 84 can be stationary or movably mounted or formed integrally therewith. One or more light sources, such as LED packages 40, can be arranged to form a matrix upon fixture plate 82 and/or platform 84. The one or more LED packages 40 can be mounted to one or more intermediate substrates 60 which can attach to one or more movable inserts 70. In an alternative, LED packages 40 and/or LED chips 46 can mount directly to inserts 70 without one or more intermediate substrates 60. In one aspect, inserts 70 can comprise an electrical circuit, for example a PCB or other suitable circuit with electrical connections or traces in which LEDs 46 or LED packages 40 may directly electrically and thermally connect. Inserts 70 can serve as a heat sink through which heat dissipates from LED chips 46 and/or packages 40. Inserts 70 can be configured, arranged, and manipulated within light fixture 80. In one aspect, inserts 70 can be slidably attached to light fixture 80. Light fixture 80 can comprise one or more slots 86 machined, or otherwise formed, in fixture plate 82. Slots 86 can serve a dual purpose within lighting fixture 80. For example, first, slots 86 can serve as conduits through which electrical wires can pass from the one or more substrates 60 with LED packages 40 through to an opposing surface of fixture plate 82. The wires can pass to one or more power sources, such as LED drivers (FIG. 10) for supplying power to illuminate the LED packages. The wires therefore, can be located below an emission surface of the LED packages 40 and not interfere with light emission. Second, slots 86 can serve as grooves by which one or more inserts 70 having LED packages 40 can be manipulated and/or configurable. For example, where inserts 70 are slidably movable upon light fixture 80, insert 70 can be secured to fixture plate 82 when screws, or other attachment devices, engage bored holes 79 of insert 70 and tighten to securely engaged insert 70 to fixture plate 82 and/or underlying substrate (not shown). Inserts 70 can be slidably movable when fastening devices withdraw from bored holes 79 of insert 70 and allow movement between bottom surface 76 of insert and fixture plate 82. Inserts 70 can move, for example, by sliding about slots 86 in directions indicated by D1 and D2. Thus, inserts 70 can be movable with respect to platform 84 and can form a more compact light emission pattern the when LED packages 40 are located closer to platform 84. An underlying substrate (not shown) may be located between an insert 70 and fixture plate 82. Underlying substrate can comprise, for example, a spacer inserted between bottom surface 76 of insert 70 and fixture plate 82 by which LED packages 40 can be located a greater distance away from, or even angled with respect to fixture plate 82 depending on the size and shape of spacer. When fastening devices are loosened from bored holes 79, inserts 70 can become loosened and disengaged from fixture plate 82 or underlying substrate. A user can manipulate, or configure, inserts 70 by sliding inserts a greater or lesser distance from platform 84 to configure the LED packages 40 such that a desirable pattern of light can be achieved.

Still referring to FIG. 7, inserts can be disposed about platform 84 in a variety of suitable formations, configurations, and/or patterns including one or more arrays and/or sectional rings. For example, inserts can be disposed in one or more ring formations. A first sectional ring, generally designated S1 can be disposed closest to and about platform 84 such that it coaxially surrounds platform 84. First sectional ring S1 can comprise one or more inserts 70. In one aspect, first sectional ring can comprise eight inserts 70 shaped substantially in a symmetrical ring having symmetrical dimensions. In the alternative, the inserts can comprise a non-symmetrical shape or a substantially oval shape. In one aspect, first sectional ring S1 can comprise four longer inserts 70 having five LED packages 40 arranged on thereon. Four shorter inserts 70 can be disposed between each of the longer inserts 70 and comprise three LED packages 40 upon each of the shorter inserts 70 within first sectional ring S1. In addition to inserts 70 movable in slots 86, inserts can be disposed and movable in any suitable manner desired and in any direction. For example, inserts 70 can move in lateral, diagonal, axial, arcuate, helical, and/or horizontal directions. Inserts 70 can move, for example, by sliding, pivoting, rocking, rotating, screwing, twisting, inclining, reclining, revolving, projecting, depressing, folding, expanding, contracting, deforming, enlarging, stretching, flexing, combinations thereof and/or any other suitable method desired. Inserts 70 can conceivably move about a universal ball joint and/or be lockable about the joint in one or more predetermined positions. Inserts 70 can also move individually or be movably connected in one or more groups.

A second sectional ring S2 can at least partially surround the outer perimeter of first sectional ring S1, thereby being located at a distance further away from platform 84 than first sectional ring S1. Second sectional ring S2 can be symmetrical, non-symmetrical, and/or comprise any suitable predetermined configuration or pattern. In one aspect, second sectional ring S2 can comprise a symmetrical ring having four longer inserts 70 alternating between four shorter inserts 70. In one aspect, the longer inserts can comprise three LED packages and the shorter inserts can comprise one LED package. In one aspect, light fixture 80 comprises first sectional ring S1 and does not comprise a second sectional ring S2. Note that first and second sectional rings S1 and S2 can be slidably moved to any desirable distance along slots 86 with respect to elevated platform 84. Also note that for illustration purposes, first and second sectional rings S1 and S2 are shown, but light fixture 80 can optionally comprise any number of sectional rings comprising any angle $\alpha$ and configured in any arrangement and/or location. Further note that first and second sectional rings S1 and S2 can comprise inserts 70 having the same and/or variable angles $\alpha$ and lengths of first and second lateral walls 75 and 77, respectively. First and second sectional rings S1 and S2, respectively, can have LED packages 40 located on a same plane and/or different planes than LED packages 40 arranged on elevated platform 82. Aside from sectional rings S1 and S2, LEDs can be configured in any suitable predetermined formation, configuration, and/or pattern.

Still referring to FIG. 7, light fixture 80 can comprise fixture plate 82 which can comprise a quadrilateral having four sides 81, 83, 85, and 87. Fixture plate 82 however, can comprise any shape and/or dimensional size desirable. Likewise, platform 84 can comprise any size, shape, and/or thickness desirable for achieving a desired light pattern. Elevated platform 84 can be disposed upon fixture plate 82 and can be affixed directly or indirectly to fixture plate 82 by using bolts, screws, adhesive, or any other feasible attachment method. Platform 84 can be located approximately center of fixture plate 82 but can be positioned in any location depending on the application and desired light emission pattern and path. As previously disclosed, LED packages 40 can electrically and thermally couple to substrates 60. Substrates 60 can thermally couple to inserts 70. Substrates 60 can electrically couple together in series forming an electrical circuit when one or more wires 88 electrically link the substrates together. For illustration purposes, only one side 83 of lighting plate 82 is shown as having wires. When connecting the substrates with LED packages in series, the anode 63 or "+" element of one substrate 60 should be linked by a wire to the cathode 67 or "−" element of an adjacent substrate 60. If connected incorrectly, one or more LED packages 40 may not illuminate. As shown by FIG. 7, one or more drive wires 89 can connect each of an end LED package 40 and/or substrate in a given series. Drive wires 89 pass beneath the LED packages 40 and into slots 86 for connecting to a power source. In another aspect, a circuit board, for example, a PCB or other patterned circuit overlay could be disposed over one or more of the inserts 70 and/or platform 84 thereby eliminating or reducing the need for one or more wires 88.

Now referring to FIG. 8, another embodiment of a light fixture is illustrated, and generally designated 90. Light fixture 90 can comprise components similar in function and form to components just described with respect to light fixture 80 with the exception of featuring one or more slidable inserts 70. For example, light fixture 90 can comprise a fixture plate 92 and a central or elevated platform 94. Fixture plate 92 can comprise a quadrilateral having four sides 91, 93, 95, and 97, but can be any size and/or shape necessary to produce a desired light emission output pattern and path. Platform 94 can be disposed upon fixture plate 92 and can also comprise any size, shape, and/or elevation necessary to produce a desired light output and pattern. Light fixture 90 can comprise one or more slots 96 machined, or otherwise formed, in fixture plate 92. In FIG. 8, light fixture 90 comprises one or more LED packages 40 mounted upon one or more substrates 60. Of note, LEDs 46 and/or LED packages 40 can mount in any suitable manner, that is, directly to one or more inserts 70 or indirectly with one or more intervening layers between LEDs and inserts 70. Substrates can be connected in series by wires 98. One or more drive wires 99 can electrically couple substrates to a power source and can pass into one or more slots 96 to connect each of the last LED packages 40 and substrates 60 for a given series to a power supply.

FIG. 8 also illustrates how one or more LED packages 40 can be located on a substrate 60 which is on a different plane than one or more other LED packages 40. For example, platform 94 can comprise a height Z which places it a distance above the surface of fixture plate 92. That is, platform 94 comprises a height Z which locates substrates 60 attached to platform 94 on a different plane than substrates 60 and LED packages 40 attached to fixture plate 92. Light fixture 90 can also comprise a fixture capable of use in both high bay and low bay applications when a group of LEDs is programmable using driver programming of one or more power supplies 100 to selectively dim and/or turn off for one or more groups of LEDs arranged on different planes.

Figure 9:
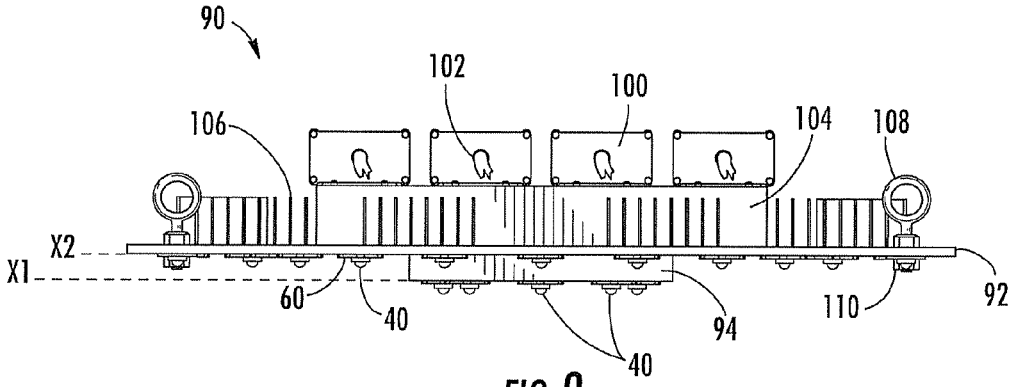
FIG. 9 illustrates a side view of the light fixture according to FIG. 8 disclosed herein.

FIG. 9 further illustrates this characteristic and depicts a side view of light fixture 90. The side view depicted in FIG. 9 is similar in form and function to a side view of light fixture 80 as well, with the exception of featuring one or more inserts 70. Light fixture 90 comprises fixture plate 92, platform 94, driver platform 104, one or more power supplies 100 and heat dissipating elements 106. Fixture plate 92 can attach to and engage platform 94, and each of which can have one or more substrates 60 with LED packages 40 attached to a surface. Driver platform 104 can be mounted to fixture plate 92 on a side opposing platform 94. One or more power supplies 100 can be affixed to driver platform 104 using a bolt or other fastening method. Power supplies 100 can comprise one or more constant current LED drivers. Power supplies 100 can supply constant but adjustable current of a variable voltage depending on the number of LED packages. A suitable power supply can comprise a switch mode power supply. The power supply can have an adjustable voltage range and the type of driver depends on a voltage drop of each of LED packages 40 within light fixture 90.

As FIG. 9 further illustrates, substrates 60 having LED packages 40 mounted thereto can be located on different planes located greater distances from the one or more power supplies 100. For example, substrates 60 with LED packages 40 affixed to platform 84 can be located on plane X1. Substrates 60 with LED packages 40 affixed to fixture plate 92 can be located on plane X2. Plane X1 is located a greater distance away from power supplies 100 than the distance to plane X2. FIG. 9 also illustrates one or more suspension elements 108. Suspension element 108 can comprise an eyebolt, hook, or similar suspension device through which a cable or suspension cord may be threaded thereby suspending light device 90 above a surface, such as a floor of a warehouse. Suspension element 108 can fixedly engage fixture plate 92 by locking nut 110 which threadingly engages onto an end of suspension element 108 and secures suspension element 108 to fixture plate 92.

Figure 10:
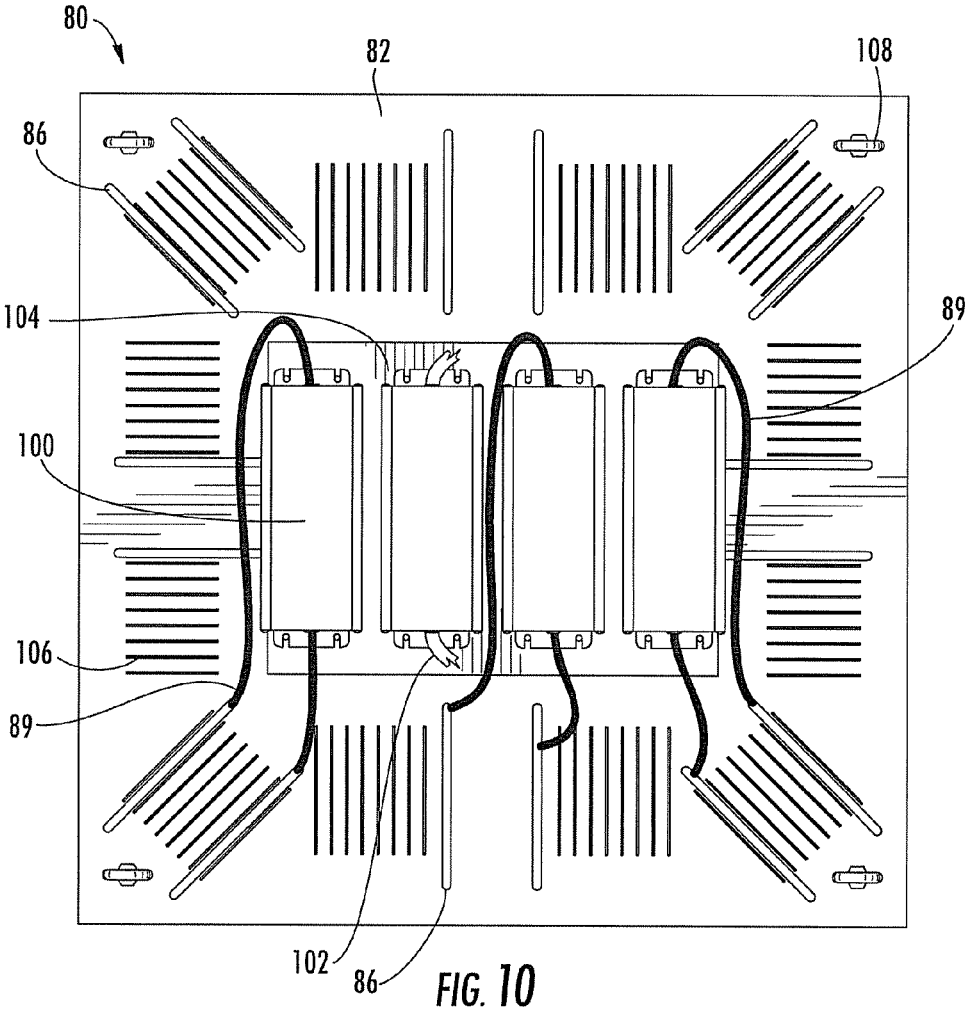
FIG. 10 illustrates a bottom plan view of the light fixtures according to FIG. 7 or 8 disclosed herein.

Referring to FIGS. 9 and 10, one or more heat dissipating elements 106 are illustrated and can be used both with light fixture 90 and light fixture 80. Heat dissipating elements 106 can comprise one more fins which can be machined and/or otherwise affixed, onto fixture plate 92 (FIG. 9) on a surface opposing platform 94. FIG. 10 illustrates a bottom view of light fixture 80. This figure could also illustrate a bottom view of light fixture 90. Light fixtures 80 and 90 can be similar in form and function with the exception of fixture 90 comprising one or more inserts 70. FIG. 10 also illustrates one or more power supplies 100 affixed using bolts or otherwise upon driver platform 104. Drive wires 89 can electrically connect one or more substrates 60 in a series of substrates 60 with LED packages 40 to the one or more power supplies 100. The one or more power supplies 100 can have one or more output cables 102 which connect power supplies 100 to an external power source, such as the electrical power grid accessed by using a power outlet. The one or more power supplies 100 can be configured such that each of output cable 102 ultimately concatenates with adjacent output cables 102 to form one output cable 102 for connecting to an external power outlet.

FIG. 10 illustrates the placement of heat dissipating elements 106 in locations on fixture plate 82 which oppose substrates 60 having LED packages 40 (FIGS. 7-9). Heat dissipating elements 106 can comprise any suitable thermally conducting material. Heat dissipating elements 106 can be formed integrally with fixture plate 82 or as a separately formed element. Heat dissipating elements 106 can thermally connect to fixture plate 82, which can thermally connect to inserts 70 (FIG. 7,13) having one or more substrates with LED packages 40. In the case of lighting fixture 90 of FIGS. 8 and 9, heat dissipating elements thermally connect to fixture plate 92 which can thermally connect to substrates 60 when substrates 60 are affixed to fixture plate 92 either directly or indirectly using a thermal adhesive or other attachment method. Heat dissipating elements 106 can comprise fins having spaces in between such that heat may dissipate into the surrounding ambient air.

Figure 11:
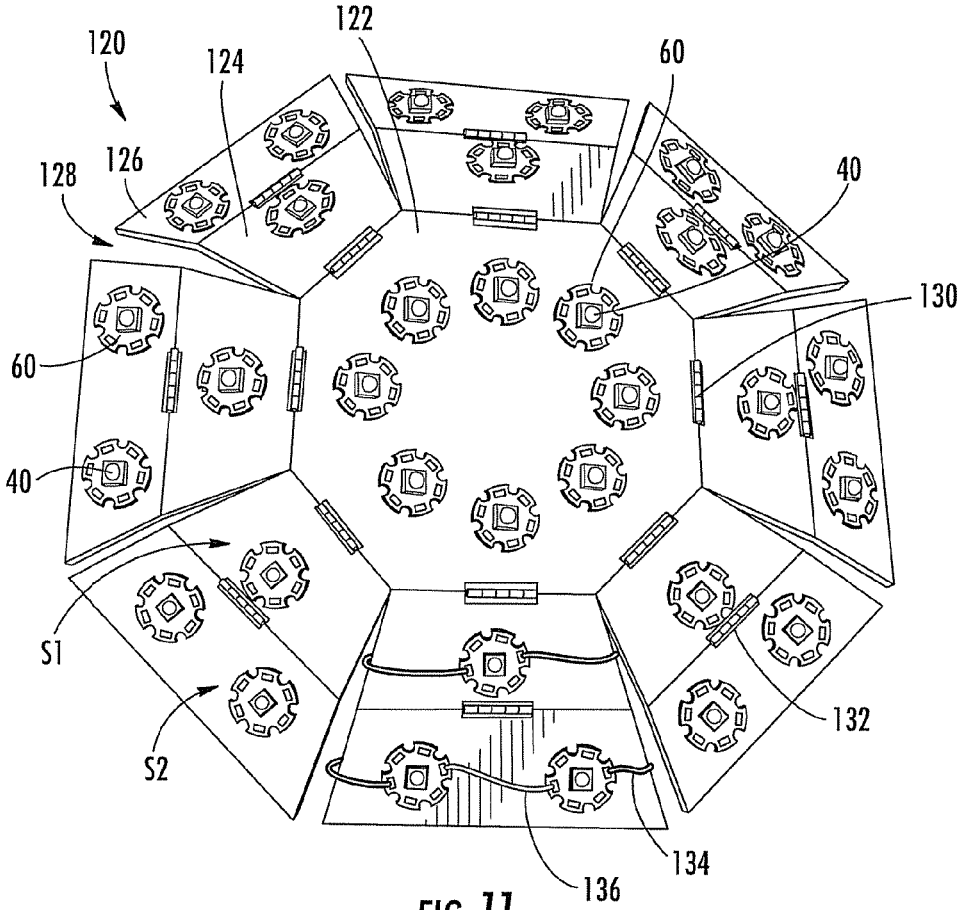
FIG. 11 illustrates an embodiment of a light fixture according to the subject matter disclosed herein.
Figure 12:
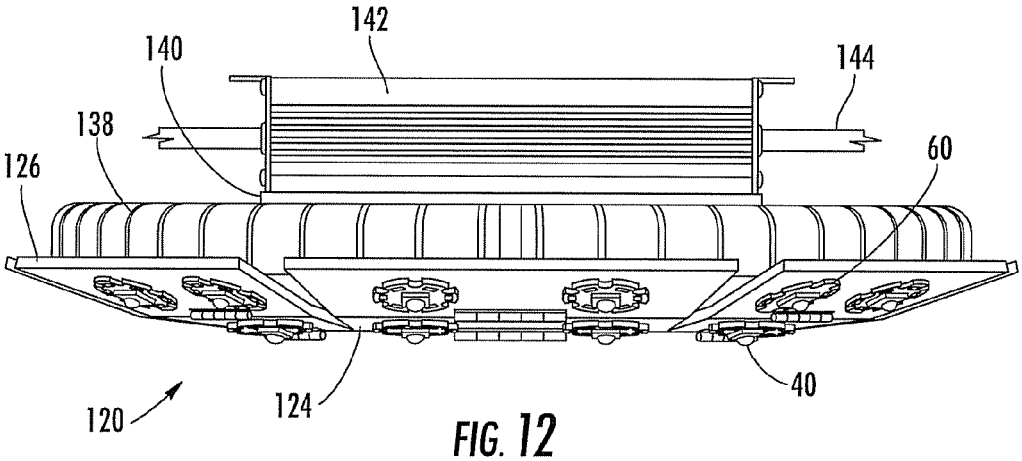
FIG. 12 illustrates a side view of the light fixture according to FIG. 11 disclosed herein.

Referring now to FIGS. 11 and 12, another embodiment of a light fixture is illustrated, and generally designated 120. Light fixture 120 can be similar to light fixture 30 shown in FIGS. 3A to 3B, in that it can comprise one or more LEDs 40 configured at angles with respect to a horizontal body portion. For example, light fixture 120 can comprise first body portion 122, one or more second body portions 124, and third body portions 126. First body portion 122 can comprise a fixture plate. Second and third body portions 124 and 126 can be rotatable about first body portion 122 by moving about respective first and second connectors. First and second connects can comprise, for example, first and second hinges. Second and third body portions 124 and 126, respectively, can further comprise segmented sections that can together form rings disposed around and at least substantially surrounding a perimeter of first body portion 122. Second and third body portions 124 and 126 can be separated into segments by one or more notches 128. Each of first, second, and third body portions 122, 124, and 126, respectively, can comprise respective groups of LED packages 40. Each respective group of LED packages 40 located upon first, second, and third body 122, 124, and 126 portions can be movable with respect to each of the other groups of LED packages 40, thereby producing variable light emission patterns.

As FIGS. 11 and 12 illustrate, first body portion 122 can comprise a substantially flat, horizontal body portion, or fixture plate, having one or more substrates 60 with LEDs arranged thereon. In one aspect, first body portion 122 can comprise eight LED packages arranged in a substantially circular pattern. One or more second body portions 124 can be hingedly connected to first body portion by one or more first hinges 130. Second body portion 124 can be configured at varying angles with respect to first body portion 122 by moving about first hinges 130 such that second body portion 124 forms a first angle with first body portion 122. In some aspects, first hinges 130 can be pre-configured to position second body portion 124 at an angle with respect to first body portion 122. In other aspects, an end user can physically manipulate the body portions to obtain a desired angle or configuration and then the hinge can be configured to lock into place after the desired configuration is reached. In one aspect, light fixture 120 can comprise eight second body portions 124, each second body portion 124 comprising one LED package 40 attached either directly or indirectly thereto.

As FIGS. 11 and 12 further illustrate, one or more third body portions 126 can be hingedly connected to second body portions 124 by one or more second hinges 132. Each third body portion 126 can be configured by moving about second hinges 132 such that each third body portion 126 forms a second angle with each corresponding first body portion 122, and forms a third angle with each corresponding second body portion 124. The first and second angles can be identical or comprise varying degrees. In one aspect, light fixture 120 can comprise eight third body portions 126, each comprising two LED packages 40 attached thereto either directly or indirectly. In one aspect, light fixture 120 can comprise a matrix of 32 LEDs, similar to FIGS. 3A to 3C. FIG. 11 illustrates second and third body portions 124 and 126, respectively, as angling in a direction below first body portion 122 such that LED packages 40 upon second and third body portions 124 and 126 are located on a plane below those of first body portion 122. However, if desired, body portions can angle above first body portion 122 in an opposite direction from that illustrated. It follows that groups of LED packages arranged on each of first, second, and third body portions 122, 124, and 126 can be located on the same or different planes within light fixture 120.

Still referring to FIG. 11, LEDs can be disposed about first body portion 122 in a variety of configurations including one or more arrays and/or sectional rings located at variable distances about first body portion 122. For example, a first sectional ring, generally designated S1 can be disposed closest to and about first body portion 122 such that it coaxially surrounds first body portion 122. First sectional ring S1 can comprise one or more LEDs adjustable and optionally selectively lockable to produce a desired light emission pattern. In one aspect, first sectional ring S1 can comprise eight LEDs within LED packages 40 shaped substantially in a symmetrical ring about first body portion 122. In the alternative, first S1 can comprise a non-symmetrical ring or a substantially oval ring. A second sectional ring S2 can at least partially surround the outer perimeter of first sectional ring S1, thereby being located at a distance further away from first body portion 122 than first sectional ring S1. Second sectional ring S2 can comprise a symmetrical or non-symmetrical shape. In one aspect, second sectional ring S2 can comprise a symmetrical ring comprising 16 LEDs positioned upon eight body portions selectively positioned and optionally lockable with respect to first and second body portions 122 and 124, respectively.

FIG. 12 illustrates a side view of light fixture 120. This view illustrates power supply 142, which can comprise one or more external LED drivers. Where LED packages 40 mount upon substrates 60, the one or more substrates 60 can connect about light fixture 120 in series, such that current flows from a power supply 142 to one or more LED packages 40. For illustration purposes, wires 136 (FIG. 11) connecting substrates 60 in series are shown only on one corresponding set of second and third body portions 124 and 126, respectively, although it is understood that wires 136 can connect LED packages 40 on each portion of the body. In another aspect, a circuit board, for example, a PCB or other patterned circuit could be disposed over one or more of the body portions thereby eliminating or reducing the need for one or more wires 136 connecting the substrates 60 with LED packages 40. One or more drive wires 134 can connect each of the last substrates 60 in a series to power supply 142. Power supply 142 can be mounted upon an elevated drive platform 140 on a surface opposing substrates 60 attached to first body portion 122. Power supply 142 can comprise one or more output cables 144 for connecting to an external power source, for example, the electrical power grid accessed using, for example, a power outlet. Drive wires 134 can connect with power supply 142 for supplying power to the one or more LED packages 40 electrically connected in series. Light fixture 120 also illustrates one or more heat dissipating elements 138. Heat dissipating elements 138 can comprise one or more fins configured to dissipate heat from the one or more LED packages into the ambient air. Heat dissipating elements 138 can be formed integrally with first body portion or as separate elements. Heat dissipating elements 138 can be thermally connected to LED packages on each of the first, second, or third body portions 122, 124, or 126 respectively. Elevated drive platform 140 can be attached, affixed, or otherwise engage at least a portion of heat dissipating elements 138 and can comprise a thermally isolating material such that heat does not dissipate into the one or more power supplies 142.

Figure 13:
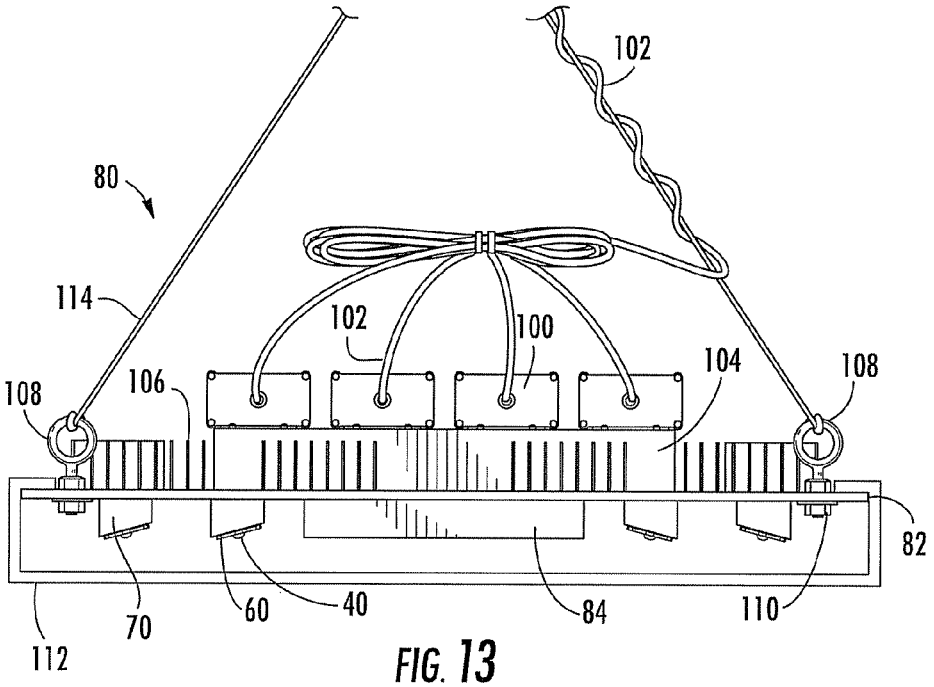
FIG. 13 illustrates an embodiment of a light system according to the subject matter disclosed herein.
Figure 14:
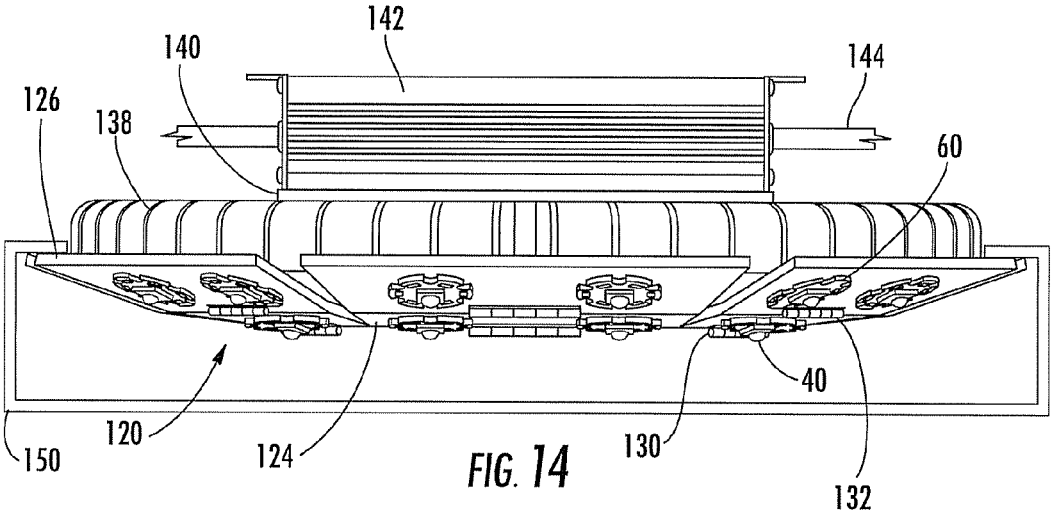
FIG. 14 illustrates another embodiment of a light system according to the subject matter disclosed herein.

FIGS. 13 and 14 illustrate lighting systems comprising light fixtures 80 and 120 which can be suspended above a respective surface. Light fixtures 80 and 120 can comprise at least one group of one or more LED packages 40 movable with respect to another group of LED packages 40, whereby movement of one group of LED packages produces variable light patterns on a surface below the suspended light fixtures 80 and 120. This ability can allow light fixtures 80 and 120 to be used in both high bay and low bay applications. For example, FIG. 13 illustrates a side view of light fixture 80 suspended using a cable 114 inserted and secured through one or more suspension elements 108. The one or more power supplies 100 comprise output cables 102 which can electrically connect, or concatenate, to form one output cable 102 which can electrically connect to the power grid accessing, for example, a power outlet. The height at which light fixture 80 may be suspended can vary, and light fixture 80 can be used for both high bay and low bay applications. FIG. 13 illustrates inserts 70 angled such that LED packages 40 mounted upon opposing inserts gradually incline towards platform 84. However, inserts 70 could optionally be angled in an opposite configuration, wherein LED packages 40 gradually incline towards suspension elements 108. Any configuration of inserts 70 can be used to obtain a desired light output emission pattern and path. Light fixture 80 can be manually or programmably configured such that LED packages 40 are movable to obtain a desired light emission pattern and path. In addition, light fixtures 80 and 120 can be manipulated using driver programming to program one or more power supplies 100 to automatically dim or turn off selected segmental rings S1, S2 and/or individual LED packages 40 arranged upon selected inserts 70. Light fixture 80 can optionally be covered by a housing container 112. Housing container 112 can comprise any material known in the art, for example, clear transparent materials including plastics and PLEXIGLAS®. Alternatively, housing container 112 can comprise any suitable diffuser material which may be non-transparent, such that the LEDs may not be directly seen or detectable and the light fixtures may or may not be seen and/or detectable. FIG. 14 illustrates a lighting system comprising light fixture 120 covered by a housing container 150. Light fixture 120 can also be manually or programmable to manipulate the location of the second and third body portions 124 and 126, respectively, at varying angles with respect to first body portion 122. Power supply 142 can be programmable using driver programming to dim and/or turn off selected body portions and/or selected LED packages 40. Housing container 150 can comprise any suitable material, for example, clear transparent materials including plastics and PLEXIGLAS® can be used. Housing container 150 can comprise any suitable diffuser material desired, for example, a semi-transparent diffuser wherein the light fixture is not seen. Light fixture 120 can be suspended in a similar manner as illustrated in FIG. 13, or can be mounted to a ceiling of a building structure. The light systems, devices, and methods herein provide selectively configurable light fixtures suitable for use in both high and low bay applications where users can manipulate and configure body portions and/or inserts upon which one or more LED packages 40 can be located.

Embodiments of the present disclosure shown in the drawings and described above are exemplary of numerous embodiments that can be made within the scope of the appended claims. It is contemplated that the configurations of multi-configurable light fixture systems, devices, and methods of making the same can comprise numerous configurations other than those specifically disclosed. It is also contemplated that light fixtures disclosed herein can be preconfigured for applications where a specific light pattern is desired. In other applications, the light fixtures can be manually or programmably configured by an end user such that the light fixture can be physically manipulated to emit light in a desired light pattern.

What is claimed is:

1. A light fixture, comprising:

a fixture plate comprising a central body portion and a plurality of peripheral body portions disposed about the central body portion, at least some of the peripheral body portions being provided directly adjacent to each other about a border of the central body portion, each of the peripheral body portions being independently movable with respect to the fixture plate and adjustably movable to different locations disposed at different distances from the central body portion;

a first plurality of light emitting devices attached to a first peripheral body portion of the plurality of peripheral body portions;

a second plurality of light emitting devices attached to the central body portion; and wherein the first plurality of light emitting devices is adjustably movable to the different locations for selectively producing variable light emission patterns with respect to the second plurality of light emitting devices.

2. The light fixture according to claim 1, wherein the first and second pluralities of light emitting devices comprise first and second pluralities of light emitting diodes (LEDs), respectively.

3. The light fixture according to claim 2, wherein the first peripheral body portion of the plurality of peripheral body portions comprises a portion of a first segmented ring and wherein a second peripheral body portion of the plurality of peripheral body portions comprises a portion of a second segmented ring.

4. The light fixture according to claim 3, wherein the first plurality of LEDs is disposed over the portion of the first segmented ring, the second plurality of LEDs is disposed over the central body portion, and a third plurality of LEDs is disposed over the portion of the second segmented ring.

5. The light fixture according to claim 4, wherein the first segmented ring is located a first distance from the fixture plate and the second segmented ring is located a second distance away from the fixture plate, and the second distance is greater than the first distance.

6. The light fixture according to claim 4, wherein portions of the first and second segmented rings are slidable with respect to the fixture plate.

7. The light fixture according to claim 6, wherein portions of the first and second segmental rings are slidable within one or more slots.

8. The light fixture according to claim 4, wherein portions of the first segmented ring are rotatable about a first connector with respect to the fixture plate, and portions of the second segmented ring are rotatable about a second connector with respect to the fixture plate.

9. The light fixture according to claim 8, wherein the first and second connectors comprise first and second hinges.

10. The light fixture according to claim 9, wherein the first and second hinges are lockable to locate the first segmented ring and the second segmented ring in first and second positions with respect to the fixture plate.

11. The light fixture according to claim 2, wherein the plurality of peripheral body portions comprises a plurality of inserts.

12. The light fixture according to claim 11, wherein the plurality of inserts comprises a plurality of LEDs disposed over each of the plurality of inserts.

13. The light fixture according to claim 12, wherein the plurality of inserts are slidable with respect to the fixture plate.

14. The light fixture according to claim 12, wherein each of the plurality of inserts comprise an angled surface.

15. A method for producing variable light emission patterns using a light fixture device, the method comprising:

providing a light fixture comprising:

a fixture plate comprising a plurality of adjacent body portions independently movable with respect to the fixture plate, where at least some of the plurality of body portions are provided directly adjacent to each other about the fixture plate; and a plurality of light emitting devices attached to each of the adjacent body portions; and moving the light emitting devices to different distances from a central portion of the fixture plate for selectively producing variable light emission patterns.

16. The method according to claim 15, wherein moving the light emitting devices comprises sliding a first body portion along a continuous path with respect to the center of the fixture plate.

17. The method according to claim 15, wherein moving the light emitting devices comprises rotating a first body portion with respect to the center of the fixture plate about a hinge.

18. The method according to claim 15, wherein moving the second body portion comprises adjusting one or more selective rings disposed about the center of the fixture plate.

19. The method according to claim 15, wherein moving the light emitting devices comprises moving the plurality of body portions between a first high bay fixture position and a second low bay fixture position.

20. A light fixture, comprising:

a fixture plate comprising a central platform and a plurality of body portions disposed about the central platform;

a plurality of light emitting devices attached to the central platform and each of the body portions; and wherein the body portions are slidably movable along a continuous linear path over a planar surface of the fixture plate between a close, minimum distance and a furthest, maximum distance with respect to the central platform to produce variable light emission patterns.

21. The light fixture according to claim 20, wherein the light emitting devices comprise light emitting diodes (LEDs).

22. The light fixture according to claim 21, wherein the body portions are disposed at least generally in a ring formation.

23. The light fixture according to claim 22, wherein the body portions comprise inserts slidably movable in one or more slots disposed on the fixture plate.

24. The light fixture according to claim 23, wherein the LEDs are positioned on an angled surface of the body portions.

25. The light fixture according to claim 24, wherein the LEDs are angled on an incline towards the central platform.

26. The light fixture according to claim 21, wherein some of the LEDs are also attached to the central platform.

27. The light fixture according to claim 21, wherein some of the LEDs are adapted to be selectively dimmed with respect to other LEDs using a programmable driver.

28. A light fixture, comprising:

a first body portion having a first group of light emitting devices attached thereto, the first body portion being non-movable and fixably disposed at a first location;

a second body portion provided directly adjacent to the first body portion, the second body portion having a second group of light emitting devices attached thereto, and whereby the second body portion is rotatable in a plurality of angles about the first body portion to produce a plurality of light emission patterns; and a third body portion provided directly adjacent to the second body portion, the third body portion comprising a third group of LEDs attached thereto, and the third body portion being rotatable with respect to each of the first and second body portions.

29. The light fixture according to claim 28, wherein the light emitting devices comprise light emitting diodes (LEDs).

30. The light fixture according to claim 29, wherein either of the first and second groups of LEDs is adapted to be selectively dimmed using a programmable driver.

31. The light fixture according to claim 28, wherein the second and third body portions are rotatable about first and second connectors.

32. The light fixture according to claim 31, wherein the first and second connectors comprise hinges lockable in a plurality of positions.

* * * * *